US011858033B2

(12) United States Patent
Burgess et al.

(10) Patent No.: US 11,858,033 B2
(45) Date of Patent: Jan. 2, 2024

(54) SYSTEM AND METHOD FOR POROUS PLUG REMOVAL AND INSTALLATION

(71) Applicant: J.H. FLETCHER & CO., Huntington, WV (US)

(72) Inventors: Timothy Burgess, South Point, OH (US); William G. Kendall, Chesapeake, OH (US); Cassidy O'Connell, Wheeling, WV (US); Dale Ferguson, Denton, KY (US); Jeff Kemper, Huntington, WV (US); Jacobus Janse Van Rensburg, Potchefstroom (ZA)

(73) Assignee: J.H. FLETCHER & CO., Huntington, WV (US)

( * ) Notice: Subject to any disclaimer, the term of this patent is extended or adjusted under 35 U.S.C. 154(b) by 0 days.

(21) Appl. No.: 18/022,849

(22) PCT Filed: Aug. 26, 2022

(86) PCT No.: PCT/US2022/041617

§ 371 (c)(1),
(2) Date: Feb. 23, 2023

(87) PCT Pub. No.: WO2023/028283

PCT Pub. Date: Mar. 2, 2023

(65) Prior Publication Data

US 2023/0226597 A1 Jul. 20, 2023

Related U.S. Application Data

(60) Provisional application No. 63/237,684, filed on Aug. 27, 2021.

(51) Int. Cl.
*B22D 1/00* (2006.01)
*B22D 41/56* (2006.01)

(52) U.S. Cl.
CPC ..... *B22D 1/005* (2013.01); *B22D 41/56* (2013.01)

(58) Field of Classification Search
CPC ..... B22D 1/005; B22D 41/56
See application file for complete search history.

(56) References Cited

U.S. PATENT DOCUMENTS 4,200,452 A 4/1980 Savov et al.
4,944,496 A 7/1990 Thrower et al.
(Continued)

FOREIGN PATENT DOCUMENTS

EP 2343386 A1 * 7/2011 ..... B22D 1/005
JP 3037284 B1 * 4/2000
JP 2003262476 A * 9/2003

*Primary Examiner* — Scott R Kastler
(74) *Attorney, Agent, or Firm* — Dickinson Wright PLLC; Andrew D. Dorisio

(57) ABSTRACT

A system and method for installing and removing a porous plug relative to a port of metallurgic ladle includes an extendable boom rotatable about vertical axis and pivotable up and down at a first end of the boom. A mast is coupled to a second end of the boom and rotatable about multiple axes relative to the boom to position or maintain the mast in a given orientation, such as in alignment with the port of the ladle in response to rotatable or pivotable movement of the boom. The mast includes a slider mast that is translatable along the length of the mast to insert the plug or retract the plug. The mast may also include jaw grippers to secure the plug and may be configured to rotate the plug relative to the mast. The system may automatically control the position and orientation of the boom, mast, and slider mast.

37 Claims, 19 Drawing Sheets

(56) References Cited

U.S. PATENT DOCUMENTS

| | | | |
|---|---|---|---|
| 5,573,724 | A | 11/1996 | Soofi et al. |
| 2006/0119019 | A1 | 6/2006 | Taferner et al. |
| 2009/0145572 | A1 | 6/2009 | Burty et al. |

* cited by examiner

SYSTEM AND METHOD FOR POROUS PLUG REMOVAL AND INSTALLATION

CROSS-REFERENCE TO RELATED APPLICATIONS

This patent application claims the benefit of U.S. Patent Application No. 63/237,684 filed on Aug. 27, 2021, the disclosure of which is incorporated herein by reference.

TECHNICAL FIELD

This disclosure is directed to metallurgy and, more specifically, to porous plug removal and installation for steel ladles.

BACKGROUND

Ladles are commonly used in metallurgy for a variety of operations. For example, ladles may be used for transport or pouring of molten metals, such as steel. One type of ladle is a treatment ladle, where the ladle may be used to change an aspect of the molten metal, such as converting cast iron to ductile iron.

One aspect of treatment ladles includes the use of one or more porous plugs disposed in the bottom of the ladle. The porosity of the porous plug allows for argon gas, for example, to be introduced, or bubbled, through the porous plug and into the ladle vessel to stir the steel. In one aspect, a white refractory stir block is installed from inside the ladle during ladle rebricking, and the porous plug is installed from outside the ladle into a port in the bottom of the ladle.

Over time, the porous plugs must be replaced due to erosion and chemical attack that inherently occurs. In one aspect, a portion of the plug is replaced, such as 4-6 inches of a 16-21 inch plug. The plugs can weigh about 75 pounds, and are typically replaced while the ladle is still substantially hot, over 1700 degrees F.

For installation of the initial plug and or the replacement plug, the plug is typically covered with a grout material, and a person will insert the plug into the stir block and hold it in position while the grout sets. There is typically a 0.5 inch clearance around the plug relative to the opening to accommodate the grout, and centering in the hole must generally be maintained. Accordingly, installing a plug requires a lot of strength by the user, because holding a 75 pound plug is difficult. Such action may exceed recommended maximum lifting requirements.

In some instances, an installation bracket may be installed on the ladle by hand and anchored thereto to assist in the installation of a porous plug. This process involves the use of various heavy lifting, with the bracket helping to center the plug, but still requiring substantial manual manipulation.

Accordingly, an objective of the present disclosure is to provide an improved system for installing and replacing porous plugs.

SUMMARY

According to an aspect of the disclosure, a system for installing and removing a porous plug for a port of a metallurgic ladle is provided. The system includes a handler configured for selectively securing and transporting the porous plug to and from the metallurgic ladle. The handler includes: a mast disposed at a first end of the handler, the mast configured for retaining the porous plug during transport; an extendable boom rotatably coupled to the mast, wherein the mast is rotatably moveable relative to the extendable boom to control alignment of the mast in response to movement of the extendable boom; a base configured for being secured to a plant floor, wherein the extendable boom is moveable relative to the base to align the mast with the port; wherein the boom is pivotable up and down relative to the base and pivotable left to right relative to the base; wherein the mast and boom are moveable relative to each other, such that the mast is positionable in an axially aligned position with a port of the ladle when the extendable boom is moved relative to the base; wherein the mast is pivotable both up-and-down and left-to-right in response to corresponding pivoting movement of the boom to position the mast in axial alignment with the port of the ladle.

In one aspect, the mast is coupled to the boom via first and second brackets, wherein the mast is rotatable relative to the first bracket, the first bracket is rotatable relative to the second bracket, and the second bracket is rotatable relative to the extendable boom.

In one aspect, the first and second brackets are right angle brackets.

In one aspect, the mast is rotatable relative to the first bracket via a mast swing gearbox, the first bracket is rotatable relative to the second bracket via a middle tilt gearbox, and the second bracket is rotatable relative to the extendable boom via a mast tilt gearbox.

In one aspect, the mast includes a pair of slider rails extending longitudinally along the mast, and a slider is slidable along the mast to advance and retract a porous plug secured thereto.

In one aspect, the mast includes a jaw gripper configured for securing a pipe of the porous plug.

In one aspect, the mast includes a plug rotation drive for rotating the porous plug within the mast.

In one aspect, the extendable boom is pivotably attached to a rotatable beam and pivotable relative to the beam, wherein the beam is rotatable relative to the base via a boom slew gearbox.

In one aspect, the handler is hydraulically controllable to raise, lower, and extend the extendable boom and to advance, retract, and rotate the porous plug secured to the mast.

In one aspect, the mast is rotatable 360 degrees relative to the first bracket, the first bracket is rotatable 360 degree relative to the second bracket, and the second bracket is rotatable 360 degrees relative to the extendable boom.

In one aspect, the second bracket is rotatable about a longitudinal axis of extension of the extendable boom.

In one aspect, an axis rotation of the mast relative to the first bracket extends through a mid-section of the mast and is perpendicular to a longitudinal axis of the mast and the direction of insertion of the porous plug.

In one aspect, the mast is positioned and aligned vertically for receiving the porous plug and is positioned and aligned horizontally for inserting the porous plug.

In one aspect, the handler has a nominal position, separated from the ladle, in which the mast and extendable boom are aligned in a first direction parallel to each other and oriented horizontally.

In one aspect, the system has a storage position, separated from the ladle, in which the extendable boom is positioned horizontally and perpendicular relative to the nominal position, and the mast is positioned vertically.

In one aspect, the mast includes at least one locating feature at a front end thereof, wherein the locating feature is sized and arranged to mate with corresponding structure disposed on the ladle when the mast is aligned with the port.

In one aspect, the corresponding structure is a locating plate defining a notch, and the locating feature on the mast is a pin.

In one aspect, the corresponding structure is a locating bracket including a bar, and the locating feature is a concave recess.

In one aspect, the bar is received in the concave recess in a positive manner and arranged to receive an axial reaction force between the mast and the ladle during installation or removal of the plug.

In another aspect, a method of installing or removing a porous plug to or from a port of a metallurgic ladle is provided. The method includes the steps of: rotating an extendable boom about a vertical axis and rotating a mast relative to the extendable boom, wherein the mast is rotatably connected to an end of the extendable boom; tilting the boom up and/or down relative to a base that is remote from the ladle and raising or lowering the boom; rotatably adjusting the mast relative to the boom in response to raising or lowering the boom, and orienting the mast horizontally; rotatably adjusting the mast relative to the boom in response to rotating the boom about the vertical axis and thereby aligning an insertion/removal axis of the mast with the port of the ladle; securing a porous plug to a slider mast; and translating the slider mast having the porous plug secured thereto along the insertion/removal axis.

In one aspect, the method further includes securing the porous plug within the mast via jaw grippers, and advancing the plug via the translation of the slider mast toward and into the port of the ladle.

In one aspect, the method includes advancing the mast into engagement with the ladle, wherein the mast includes a locating feature, and mating the locating feature with a corresponding locating feature on the ladle.

In one aspect, the locating feature is a pin disposed on a front plate of the mast, and the corresponding locating feature is a notch defined in a locating plate attached to the ladle.

In one aspect, the locating feature is a bracket having a concave recess and the corresponding locating feature is a bar attached to the ladle.

In one aspect, a reaction force during insertion or removal of the ladle is reacted on by the bar and recess in the direction of insertion/removal.

In one aspect, the method includes securing the porous plug within the mast via jaw grippers while the plug is secured to the ladle, and retracting the plug via the translation of the slider mast toward and into the port of the ladle.

In one aspect, the method includes, prior to retracting the plug, introducing air or gas to the plug via the pipe and cooling the plug.

In one aspect, cooling the plug causes grout surrounding the plug to crack, thereby loosening the plug relative to the ladle.

In one aspect, the method includes, prior to securing the plug to the mast, orienting the mast vertically and, thereafter, advancing the mast onto a vertically aligned plug and securing the plug within the mast.

In one aspect, the method includes, after securing the plug to the mast, removing the plug from the ladle and, thereafter, orienting the mast vertically and releasing the plug.

In one aspect, the extendable boom is pivotable about the vertical axis via a boom slew gearbox, the mast is rotatable relative to the boom via a middle tilt gearbox, and the mast is further rotatable relative to the extendable boom via a mast swing gearbox.

In one aspect, the method includes correspondingly rotating the mast via the mast swing gearbox in response to pivoting the extendable boom about the vertical axis to maintain an alignment of the mast relative to the ladle.

In one aspect, the boom, mast, and slider mast are positionable automatically by a controller having a processor and a non-transitory computer readable medium with instructions stored thereon and configured for automatically controlling the positions, and wherein the steps are automated by the controller.

In another aspect, a system for installing a porous plug in a port of a metallurgic ladle is provided. The system includes a mast configured for selectively securing and transporting the porous plug to and from the metallurgic ladle, the mast configured for rotating the porous plug while the mast remains stationary.

In one aspect, the mast comprises a slider mast configured to translate the porous plug to and/or from a port of the metallurgic.

In one aspect, the mast is positionable relative to an extendable boom, wherein the boom is rotatable at a first end about a vertical axis and pivotable up and/or down at the first end, and the mast is coupled to a second end of the boom and rotatable about multiple axes to maintain the mast in alignment with the ladle while the boom is rotated and/or pivoted.

In another aspect, a method of installing or removing a porous plug in a port of a metallurgic ladle is provided. The method includes the steps of connecting a mast with a porous plug in a container, and advancing the plug via the mast into the port of the metallurgic ladle.

In one aspect, the method includes the step of using the mast to rotate the porous plug relative to the mast.

In one aspect, the method includes the step of applying a coating to the porous plug during rotation.

In one aspect, the method includes rotating the mast about multiple axes relative to an extendable boom coupled to the mast, wherein the mast is rotated to corresponding to the rotation of the boom about a vertical axis and/or pivoting of the boom up and/or down to maintain the mast in a given orientation.

DETAILED DESCRIPTION

Figure 1:
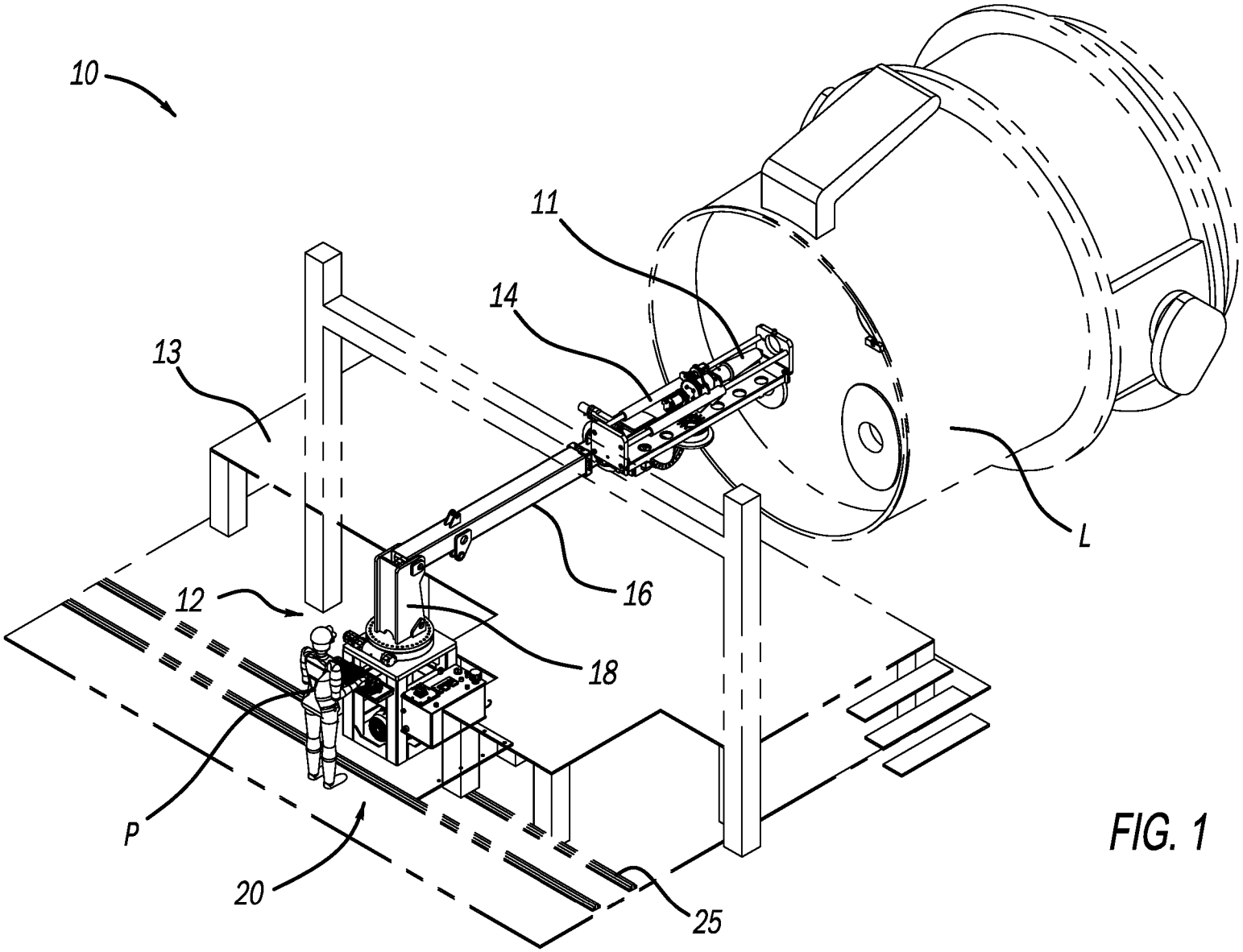
FIG. 1 is perspective view of a system for installing and removing a porous plug relative to a port of a metallurgic ladle.

In the following detailed description, numerous specific details are set forth to provide a thorough understanding of the present invention. The disclosed embodiments may be practiced without these specific details. In other instances, well-known methods, procedures, components, or structures may not have been described in detail so as not to obscure the present invention.

The dimensions of some of the elements may be exaggerated relative to other elements for clarity or several physical components may be included in one functional block or element. Further, sometimes reference numerals may be repeated among the drawings to indicate corresponding or analogous elements. Moreover, some of the parts depicted in the drawings may be combined into a single function.

The invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein are for the purpose of description and should not be regarded as limiting.

Certain features of the invention that are, for clarity, described in the context of separate embodiments, may also be provided in combination in a single embodiment. Conversely, various features of the invention that are, for brevity, described in the context of a single embodiment, may also be provided separately or in any suitable sub-combination.

In accordance with FIG. 1, a porous plug removal and installation system 10 is shown and outlined further in the following description. The system 10 includes a porous plug handler 12. The handler 12 includes a mast 14 disposed at the end of the handler 12. The mast 14 is rotatably connected to an extendable boom 16. The boom 16 is pivotably connected to a rotatable beam 18, which is rotatably mounted to a base 20 that may be fixed in place to the plant floor or other stationary surface. The system 10 is capable of both installing a porous plug into a corresponding port of a ladle L, whereby grout surrounding the plug will harden, and is also capable of removing a previously installed plug from the ladle. In one aspect, the base 20 may be slidable and lockable along a rail system 25, such that the system 10 may be moved away from the ladle L to a storage area or the like, or may be moved to another ladle in an adjacent area. In another aspect, the base 20 may be bolted or otherwise fixed in place to the floor of the work site.

The handler 12 is configured to be moveable relative to the ladle L and may be controlled by a person P to reliably install a porous plug 11 in the port of the ladle L, or else automated as outlined further in the following description. The handler 12 is adjustable via pivoting and rotation of its components to align a porous plug 11 with ports located at various locations, depending on the size and type of ladle L being used.

Figure 2:
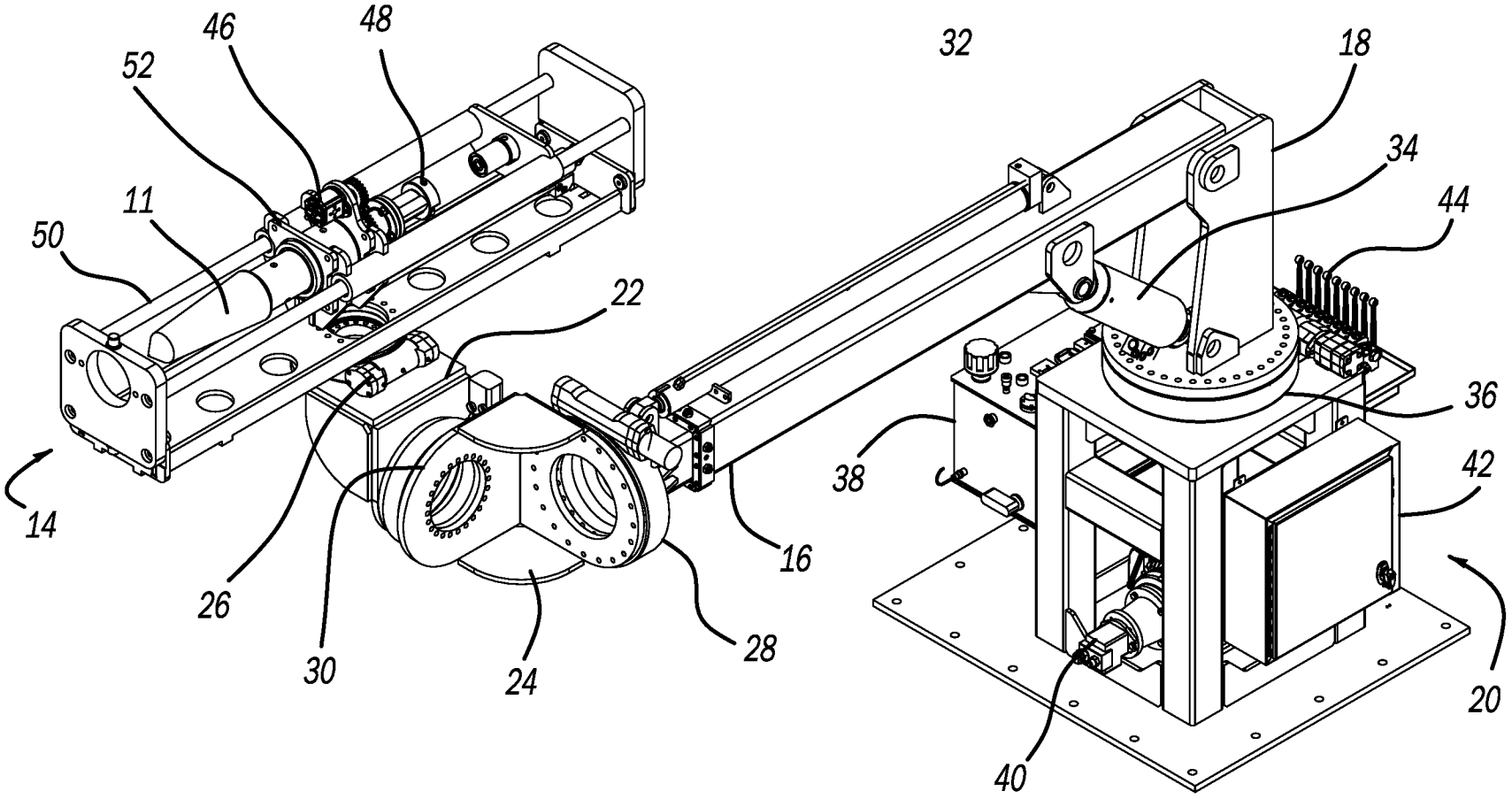
FIG. 2 is a perspective view of an extendable boom, a mast, and a slider boom of the system that are controllable via gearboxes and/or hydraulics by a controller.

The handler 12 is shown in more detail in FIG. 2. As can be understood from this figure, the mast 14 may take the form of a slider mast. The mast 14 may be rotatably coupled to the extendable boom 16 via a first right angle bracket 22 and a second right angle bracket 24. The first bracket 22 is coupled to the middle of the mast 14 via a mast swing gearbox 26, allowing the mast 14 to rotate 360 degrees relative to the first bracket 22. The second bracket 24 is coupled to the end of the extendable boom via a mast tilt gearbox 28. This allows the second bracket 24 to rotate 360 degrees relative to the end of the extendable boom 16 (and therefore also allowing the mast 14 to rotate 360 degrees around the end of the boom 16). The first bracket 22 and the second bracket 24 are coupled via a middle tilt gearbox 30, allowing the first bracket to rotate 360 degrees relative to the second bracket 24. Thus, as is evident, via actuation of the various gearboxes, the position and orientation of the slider mast 14 can be adjusted to accommodate various positioning demands.

In addition to the angular orientation afforded by the various gearboxes, the extendable boom 16 allows for further positioning of the mast 14. The extendable boom 16 includes a boom extend cylinder 32 for extending the boom 16 and a boom lift cylinder 34 for lifting and lowering the boom relative to the rotatable beam 18. The beam 18 is coupled to the base 20 via boom slew gearbox 36, allowing the beam 18 and the boom 16 coupled thereto to pivot about the base up to 360 degrees. However, the necessary range of pivoting for the operations disclosed herein may not be as high as 360 degrees. In one aspect, the swing or slew range of the handler 12 and the boom 16 may be about 140 degrees. However, this range shall not be interpreted as limiting.

The base 20 may include a hydraulic tank 38, a hydraulic pump and electric motor module 40, and an electrical control enclosure 42. A hydraulic control valve bank 44 may also be disposed on the base 20 for controlling the various hydraulic mechanisms of the handler 12.

With continued reference to FIG. 2, the slider mast 14 at the end of the handler 12 may include a porous plug 11, a rotatable hydraulic drive 46 and a jaw gripper 48. The hydraulic drive 46 is configured to rotate the porous plug 11 once inserted into the port in a controlled manner. The jaw gripper 48 may comprise a cylinder configured to grip and clamp a pipe attached to the plug 11 to control the rotation and translation of the plug 11. The mast 14 further includes a pair of rails 50 along which a slider mast 52 can be hydraulically controlled translationally to slide the plug 11 in the direction of the orientation of the mast 14 and into the port in the ladle L.

Figure 3A:
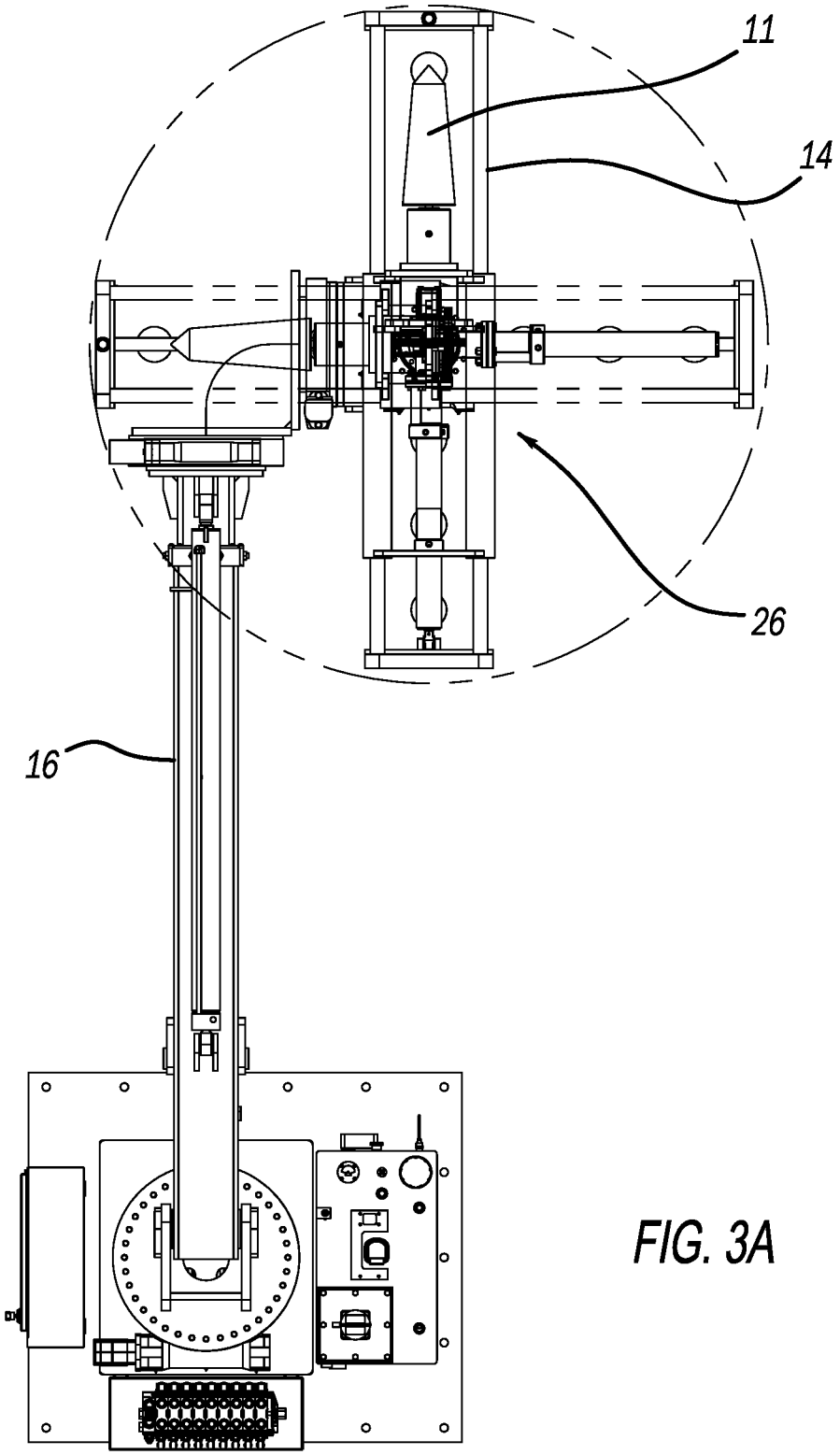
FIG. 3A is a top view of the system illustrating relative rotation of the mast about a vertical axis.
Figure 3B:
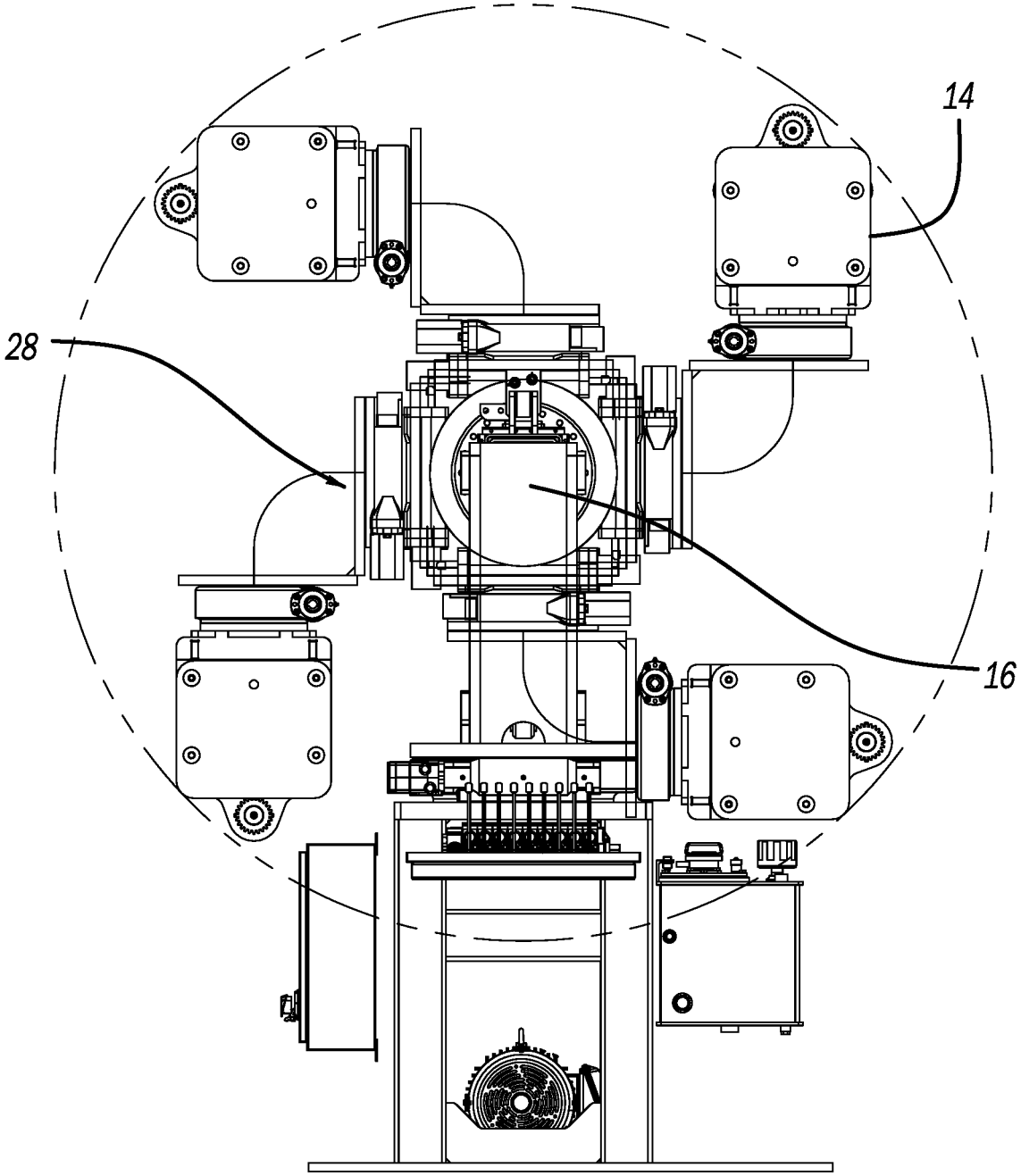
FIG. 3B is a front view of the system illustrating relative rotation of the mast about a horizontal axis.
Figure 3C:
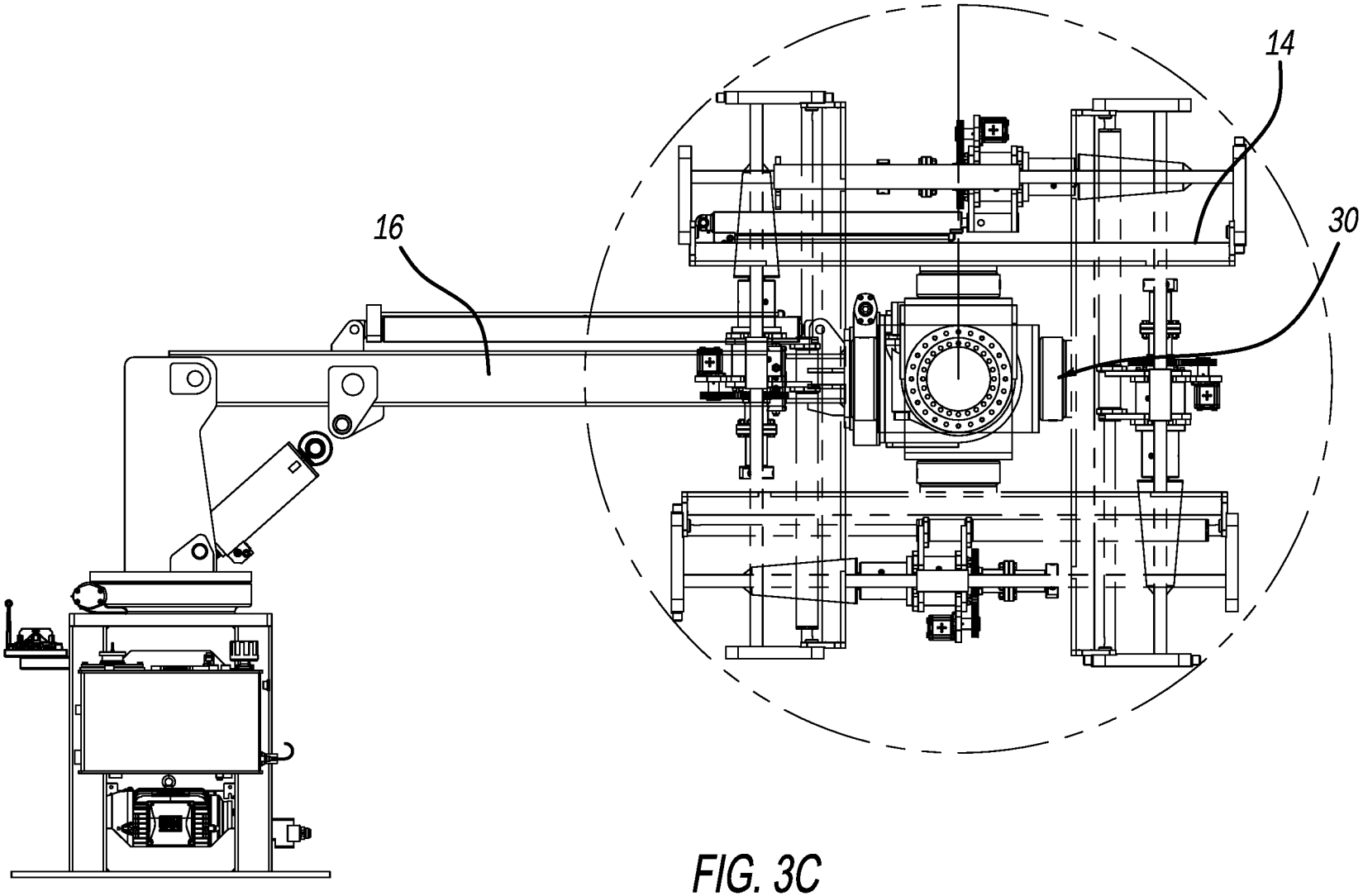
FIG. 3C is a side of the system illustrating relative rotation of the mast about another horizontal axis.

FIGS. 3A-D provides multiple views of the handler 12 in different orientations and positions of the mast 14 and boom 16 in accordance with the components described above. The top view of FIG. 3A of the handler 12 illustrates 360 degree rotation of the mast 14 via the mast swing gearbox 26. The front view of FIG. 3B of the handler 12 illustrates 360 degrees of rotation of the mast 14 via the mast tilt gear box 28. FIG. 3C shows one side view of the handler 12 and illustrates 360 degrees of rotation of the mast 14 via middle tilt gear box 30. It will be appreciated that 360 rotation via one gearbox may not be possible in some positions of the boom 16 and the other gearboxes.

Figure 3D:
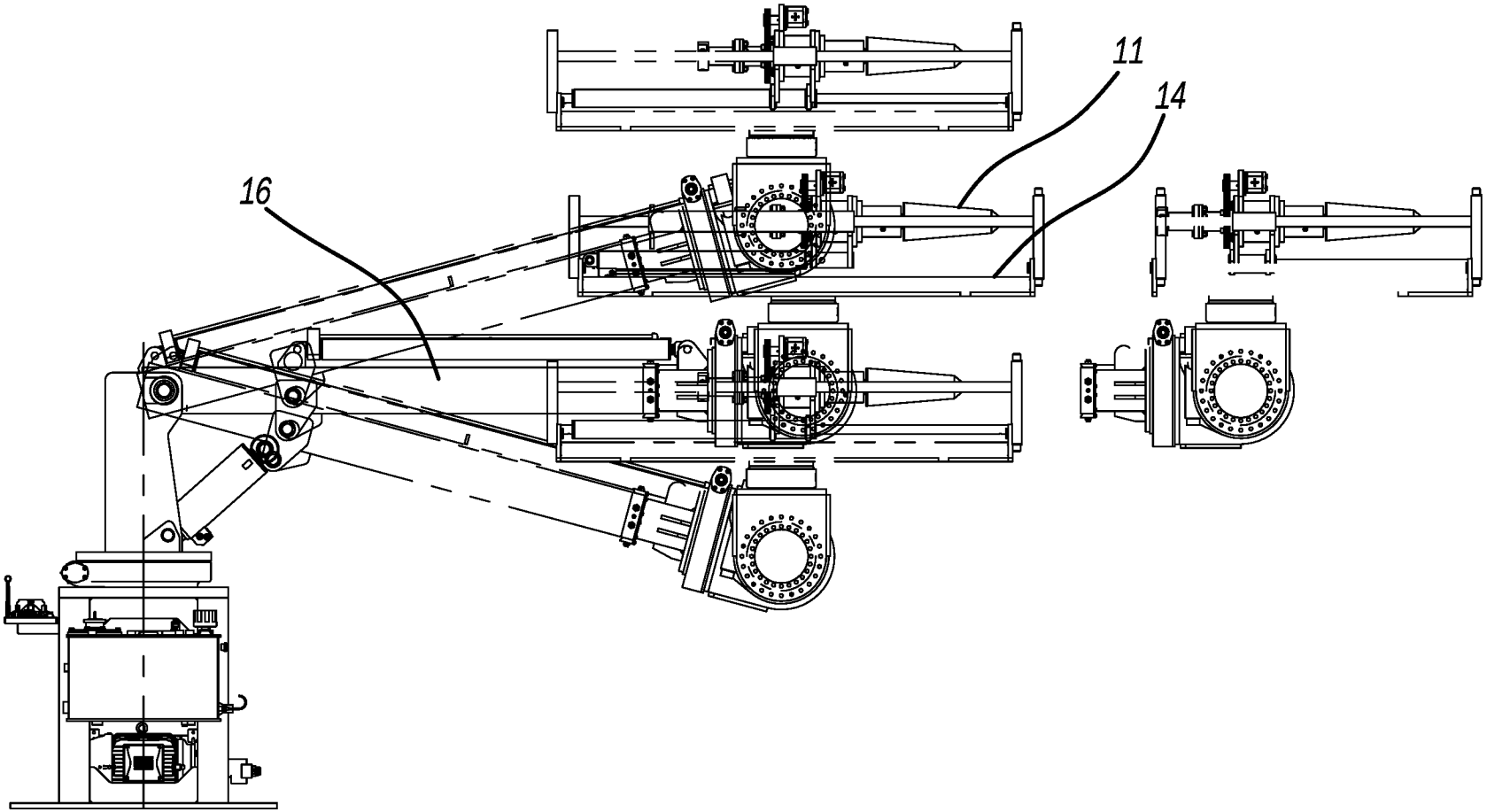
FIG. 3D is a side view of the system illustrating pivoting movement of the extendable boom up and down, extension of the extendable boom, and corresponding rotation of the mast to align the mast horizontally.

FIG. 3D shows another side view of the handler 12 and illustrates the boom 16 in different elevated positions (both lifted and lowered) as well as an extended position. An extended position of the boom 16 is also shown. In each of the positions shown, the mast 14 may be adjusted via middle tilt gearbox 30 to remain generally horizontal. Similar adjustments to the mast 14 may be made via mast swing gear box 26 when the boom 16 is pivoted, or in a slewed position, via boom slew gearbox 36, such that the mast 14 may be aligned normal or perpendicular to the ladle L and aligned with typical port axis.

Figure 4:
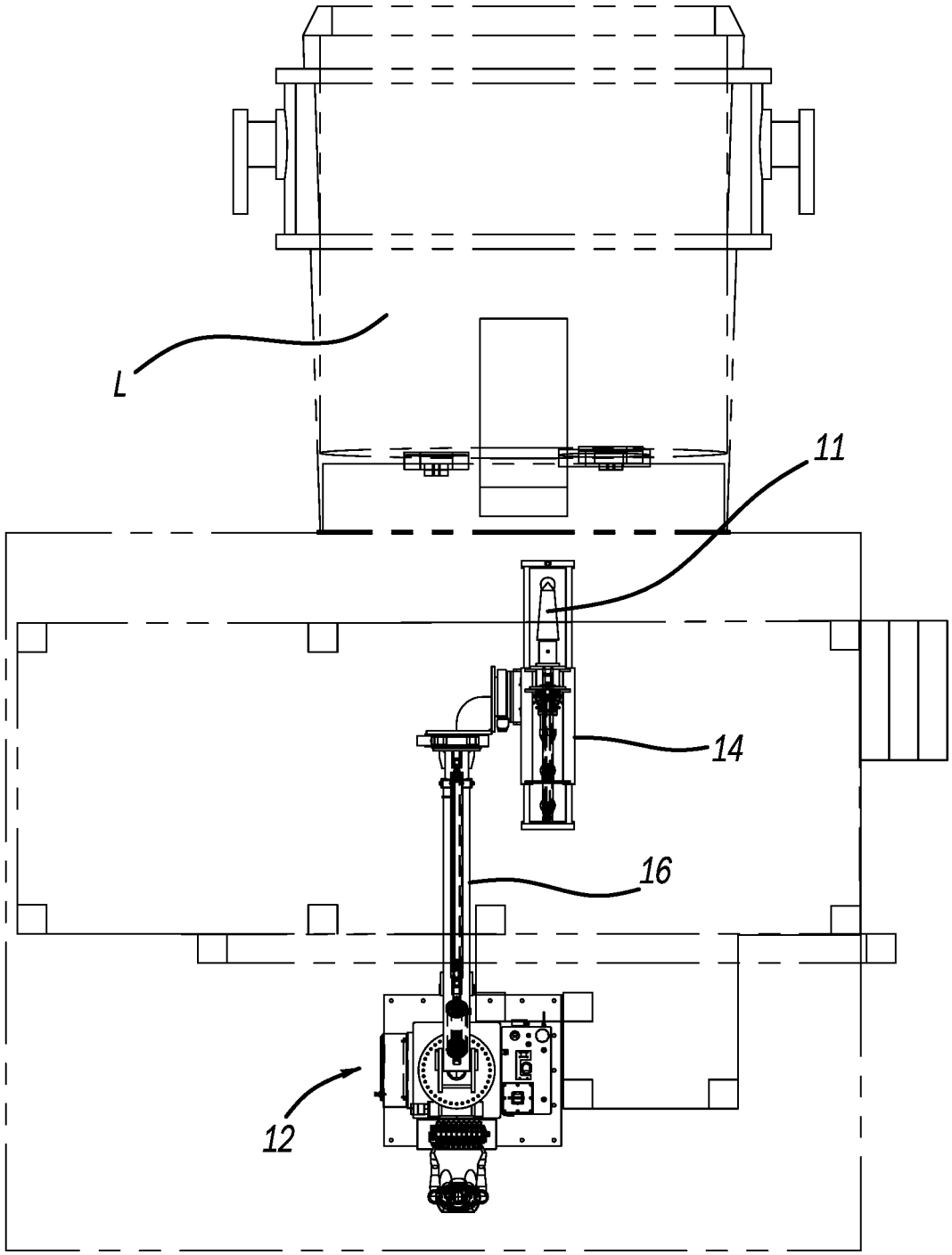
FIG. 4 is a top view of the mast illustrating a boom slew range according an aspect of the disclosure.

In this regard, one example of a boom swing range is illustrated in FIG. 4. FIG. 4 illustrates a top view of the handler 12, with an exemplary swing range illustrated at about 140 degrees. The boom is illustrated in a nominal position, with the range extending about 90 degrees to the right and 50 degrees to the left. The mast 14 is shown parallel to the boom 16, and normal to the face of the ladle L such that the porous plug 11 may be inserted in the direction of the ladle L. If the boom 16 swings to the left or right, the mast 14 may corresponding swing in the opposite direction to accommodate, such that the mast 14 will remain normal to the ladle L. The above-described boom swing range, however, may be greater. For example, the boom 16 may be pivoted or slewed up to 140 degrees to the right or left from the nominal position depending on the aspects of the plant in which the system is installed. In another aspect, the boom 16 could be arranged to pivot even beyond the 140 degrees to the right or left, Thus, the mast 14 may be raised and lowered, shifted left to right, and extended toward and away from the ladle L based on movement of the various interconnected components of the handler 12, and can remain oriented in a desired direction of insertion for the plug 11.

When aligned in the desired position and orientation, the mast 14 may mate with the ladle L, such that the porous plug 11 may be inserted in a controlled and predictable manner into the port, and held in place, such that the grout around the plug 11 can set and hold the plug 11 in place as intended.

With reference to FIGS. 5A-5E, the mast 14 is illustrated, in part, to show its alignment with the port on the ladle L. The mast 14 includes a front plate 54, shown in FIG. 5A, which includes pins 54*a*, and 54*b* disposed at the center of the upper and lower edges of front plate 54. The pins 54*a*, 54*b* extend generally vertically up/down from the front plate 54, and provide a locating feature for the mast 14. In particular, the pins 54*a*, 54*b* are sized and configured to be received a corresponding structure that is attached to the ladle L.

Figure 5A:
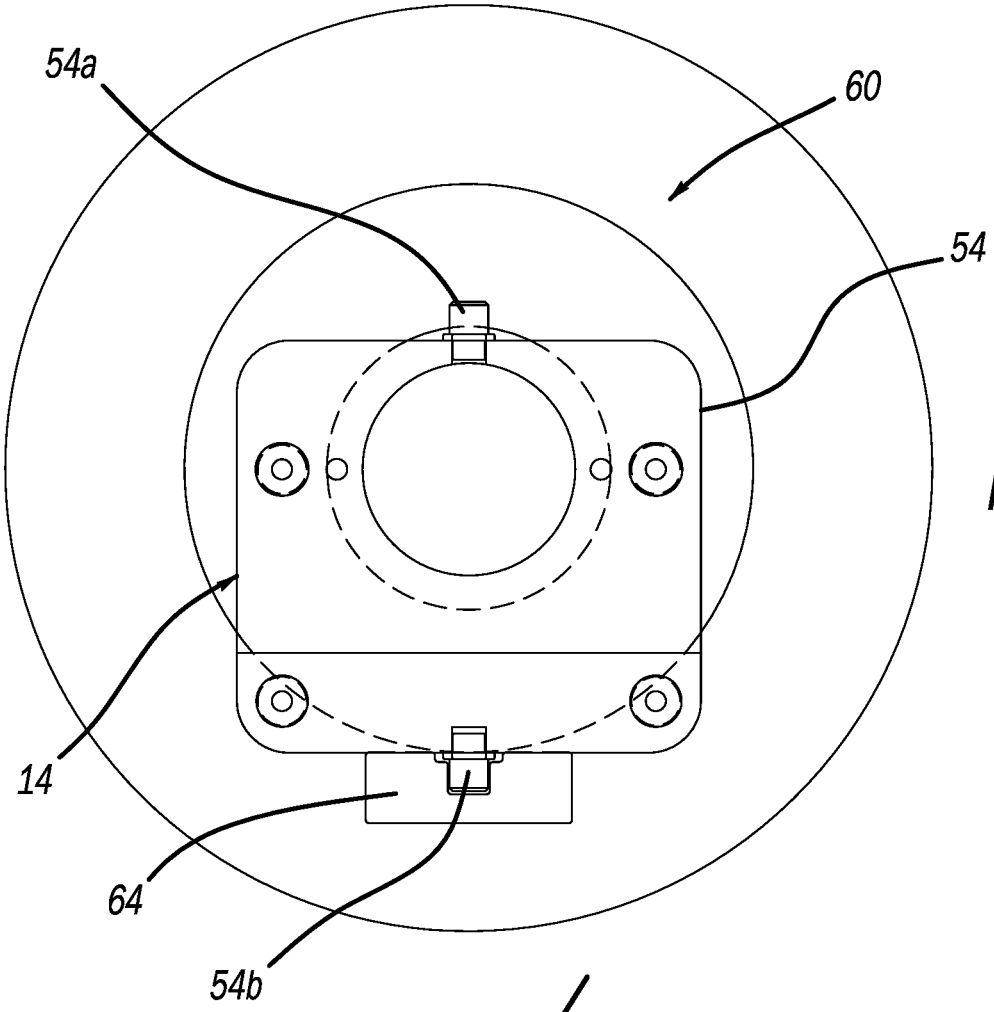
FIG. 5A is a front view of a locating feature of the mast for locating the mast with a port of the ladle.
Figure 5B:
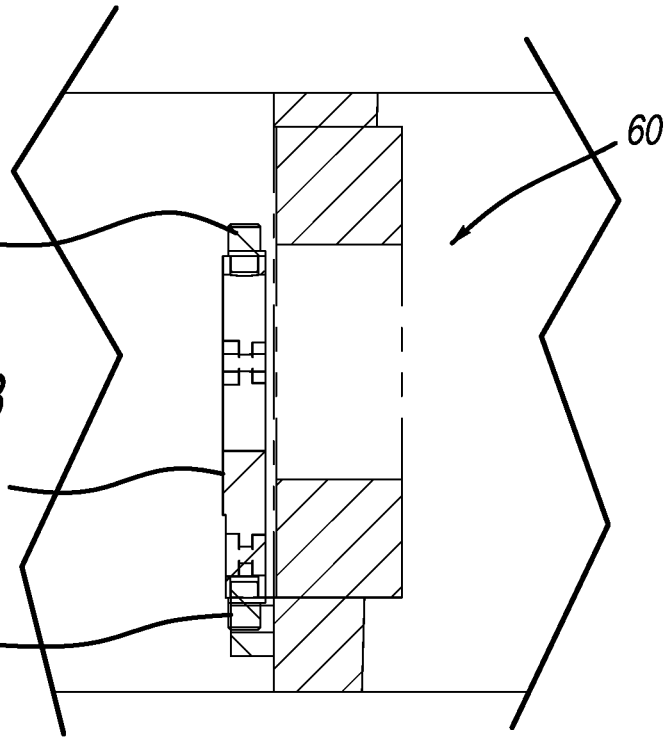
FIG. 5B is a cross-sectional view of the mast being aligned with a corresponding locating feature on the ladle.
Figure 5C:
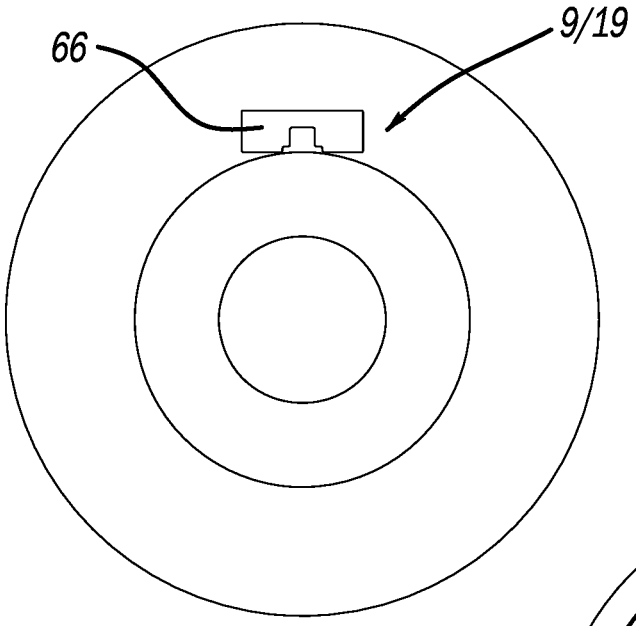
FIG. 5C is a front view of another port and corresponding location feature of the ladle.
Figure 5D:
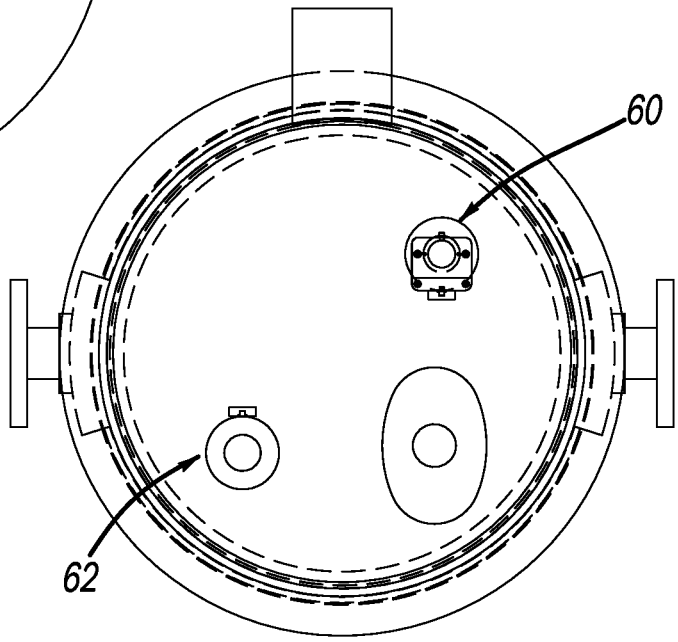
FIG. 5D is a front view of the ladle illustrating multiple ports.
Figure 5E:
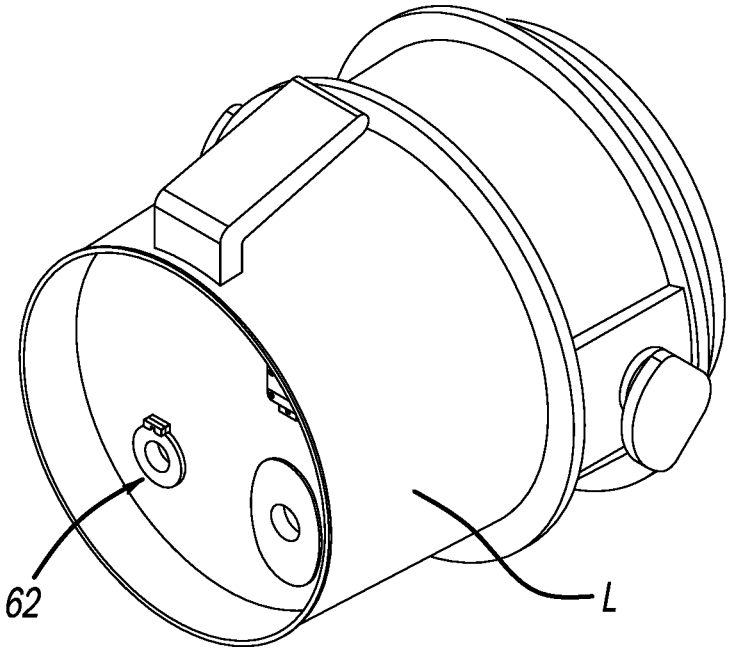
FIG. 5E is an isometric view of the ladle illustrating multiple ports'

FIG. 5A and FIG. 5C illustrate detailed views of ports 60 and 62 of the ladle L, seen in the front view of FIG. 5D and the perspective view of FIG. 5E. Port 60 is disposed at approximately "2 o'clock" on the bottom face of the ladle L, with port 62 disposed at about "8 o'clock" on the bottom of the ladle L. In this aspect, the ports are about 180 degrees apart, or diametrically opposed relative to the central axis of the ladle L. It will be appreciated that these particular locations are one example, and that different ladle configurations can include fewer ports, more ports, and/or ports located in different locations on the bottom face of the ladle L. It will also be appreciated that throughout the figures the ladle L is shown on its side, such that the bottom face of the ladle L is presented to the handler 12 and such that the porous plug 11 may be inserted horizontally toward the ports of the ladle L.

In the illustrated arrangement, with ports 60 and 62 being diametrically opposed, the ladle L, if rotated on its side in the opposite direction from vertical would result in ports 60 and 62 appearing similar when viewing the bottom face, with one at 2 o'clock and the other at 8 o'clock, but reversed. Port 62 would be at 2 o'clock and port 60 would be at 8 o'clock.

FIG. 5A illustrates the mast 14 and front plate 54 axially aligned with the port 60. In this illustration, ladle L includes a locating plate 64 welded or otherwise secured to the bottom face of the ladle L. The locating plate 64 defines a notch, into which the pin 54*b* (at the bottom of front plate 54 in this example) may be received to align the mast 14 with the port 60. FIG. 5C similarly illustrates a locating plate 66 welded or otherwise secured to the bottom face of the ladle L, with the locating plate 66 defining a notch sized and configured to receive pin 54*a* when the mast is aligned with port 62, as shown in the cross-section of FIG. 5B. In one aspect, the locating plates 64 and 66 are multiple plates of similar shape welded on top of each other to increase thickness. As shown, locating plate 64 is at the bottom of the port 60 and locating plate 66 is at the top of the port 62. It will be appreciated that the locating plates 64, 66 could both be at the top or at the bottom. Similarly, the pins 54*a*, 54*b* could be in the form of a single pin and/or located at various points on the front plate 54, with the locating plates similarly located in a corresponding position on the ports of the ladle L. In another aspect, multiple locating plates can be disposed around a single port, such that plates are disposed at both the top and the bottom of the port.

In the case of the ladle L being rotated to its side in the opposite direction, as described above, the arrangement where one of the locating plates 64, 66 is above its corresponding port and the other locating plate 64, 66 is below its corresponding locating port would be similarly arranged, due to the illustrated 180 degree symmetry.

During the installation process of the porous plug 11, the mast 14 can therefore be adjusted in its position to be aligned with the desired port (60 or 62 as shown in FIG. 5D) of the ladle L. With the mast 14 aligned, the mast can be advanced axially/horizontally toward the port on the ladle L, with the pin of the front plate 54 being received in the locating plate of the port, confirming that the mast 14 is aligned with the port in the desired position. Thus, when the porous plug 11 is inserted into the port, the grout around the outside of the plug 11 can be generally consistently provided between the plug 11 and the inner wall of the port.

Figure 6:
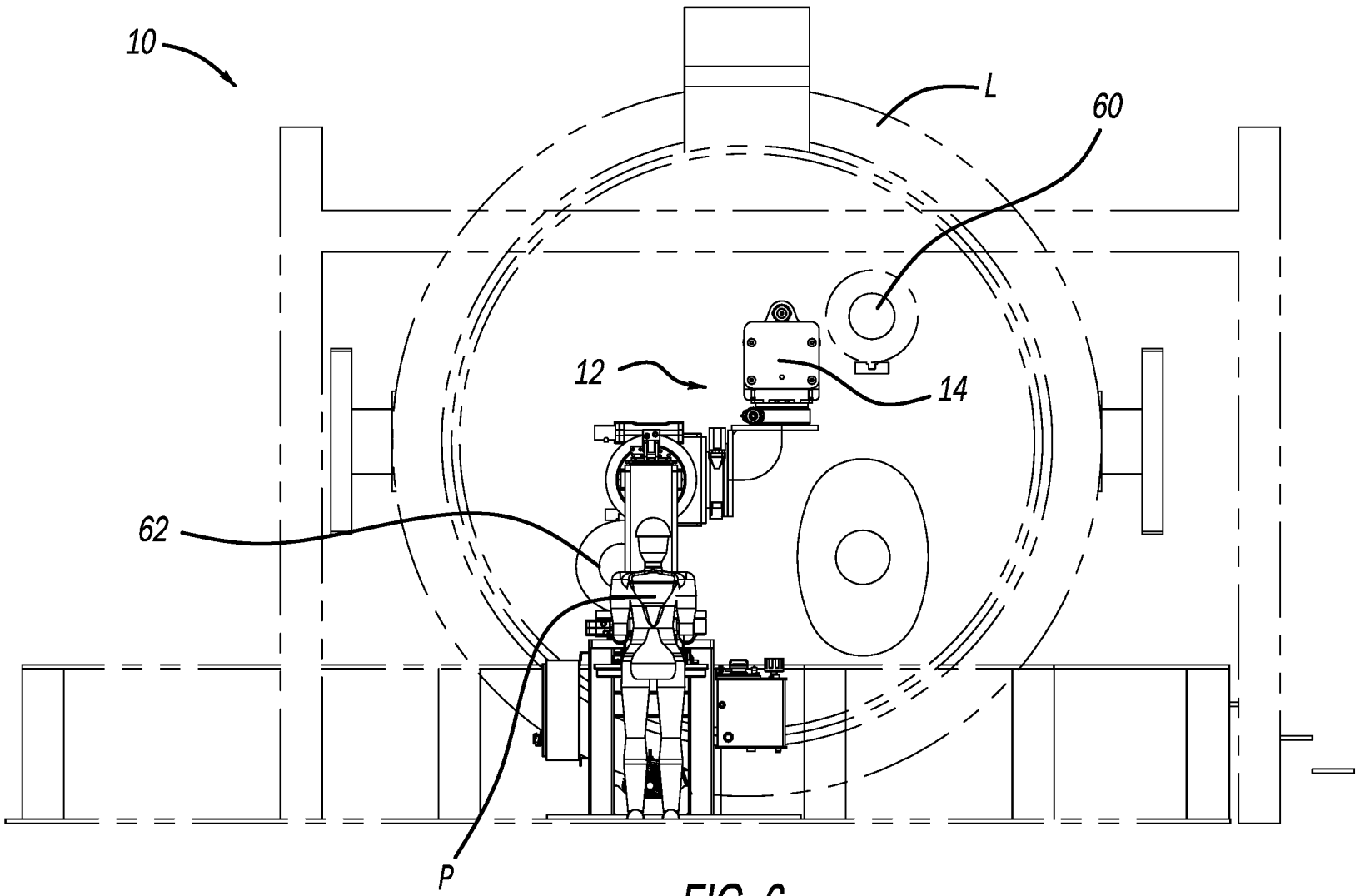
FIG. 6 is a front view of the system in a nominal position and in position for controllable movement toward one of the ports of the ladle.

FIG. 6 illustrates an end view of the system 10 and the handler 12, with the mast 14 in position between the ports 60 and 62, and not aligned with either port 60. To align with the port 60 on the upper right, the mast 14 may be raised from its illustrated position via the boom 16 being tilted upward. The mast 14 may also be shifted to the right via rotatable beam 18. The mast 14 can be tilted downward via middle tilt gearbox 30 to counteract the upward tilt of the boom 18. Similarly, the mast 14 may be rotated to the left via mast swing gearbox 26 to counteract the shift to the right by the beam 18. To reach port 62 instead, similar opposite movements (relative to those described immediately above) can be performed. It will be appreciated that similar movement combinations may be made to reach other potential port locations.

In one aspect, the handler 12 can be tared to a predetermined reference location on the ladle L relative to known predetermined positions of the ports (such as ports 60 and 62). The system 10 may include a controller (such as a computer having a processor and non-transitory computer readable medium) that can be configured to automatically move the mast 14 from its nominal position or tared position to the predetermined known location of the ports. The operator person P may fine tune the location of the mast 14 via manual control, if necessary. The operator person P may also move the mast 14 manually without using a controller with predetermined programmed movements, if desired.

Figure 7:
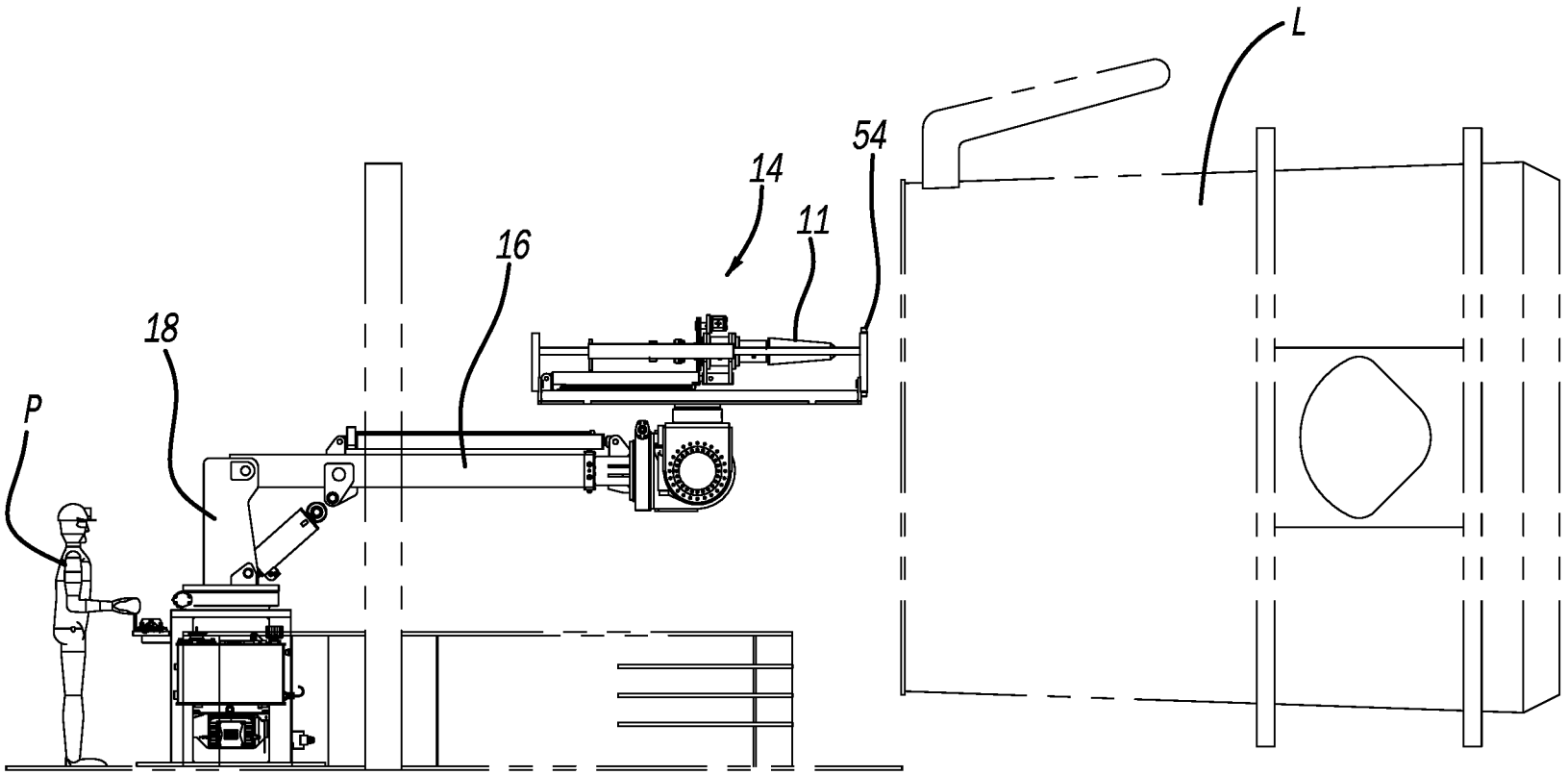
FIG. 7 is a side view of the system in the nominal position.

FIG. 7 illustrates a position corresponding to that shown in FIG. 6, and further illustrates the extendable boom 16 in a retracted position, and with the mast 14 shown in a nominal position thereof with the porous plug 11 not yet extended from the mast 14. Once aligned with one of the ports on the ladle L, the mast 14 (and the slider thereof) may be actuated to move the porous plug 11 from left to right in FIG. 7.

FIG. 7 further illustrates that as boom 18 is tilted upward, mast 14 can be tilted downward. To bring mast 14 closer to the ladle L or the port(s) thereof, extendable boom 18 may be extended. When tilted, such extension of the boom 18 will further raise the mast 14. Accordingly, as the boom is extended toward the ladle L, the boom may correspondingly be lowered slightly (and the mast 14 tilted upward) to align the mast 14 with the port, and ultimately bring the front face 54 of the mast 14 into engagement with the port (and the locating features of the port).

The above described system 10 and handler 12 have been described with reference to the porous plug 11 being held in the mast 14 such that it can be introduced toward and into the port of the ladle L. However, the system 10 is also configured to easily load a porous plug 11 without substantial manual labor.

Figure 8A:
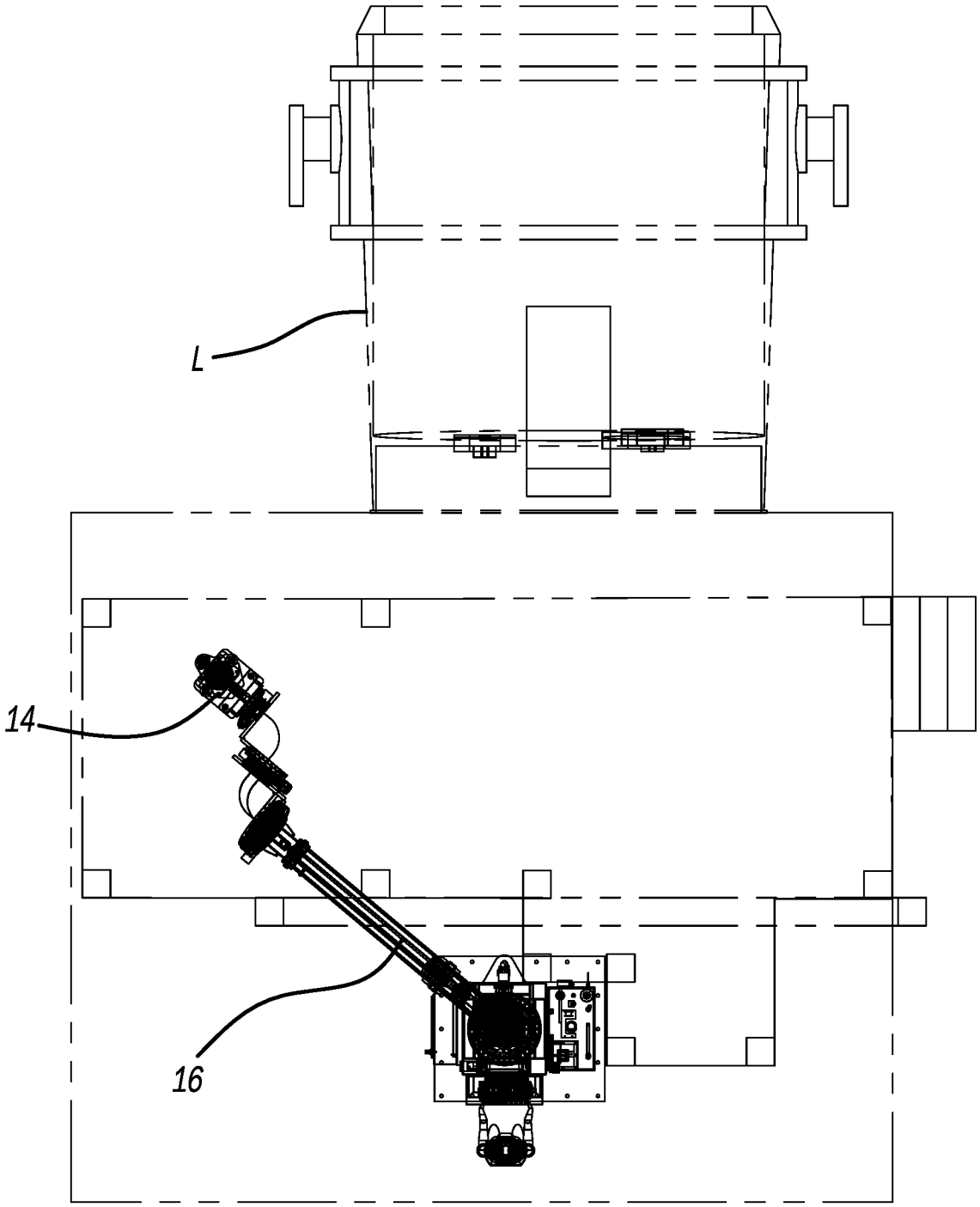
FIG. 8A is a top view of the system in position to retrieve a plug from a plug supply with the mast aligned vertically.
Figure 8B:
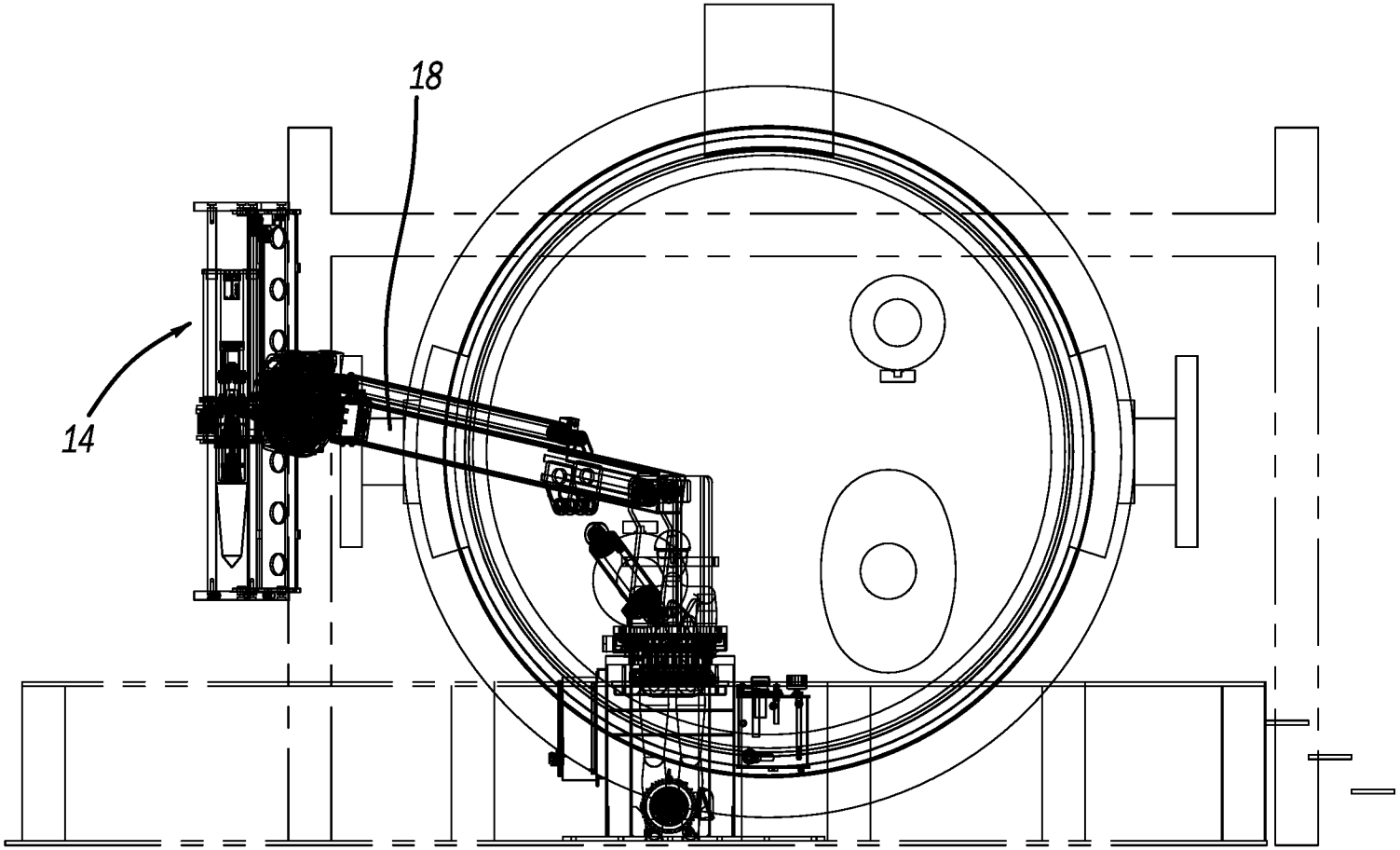
FIG. 8B is a front view of the position of FIG. 8A.
Figure 8C:
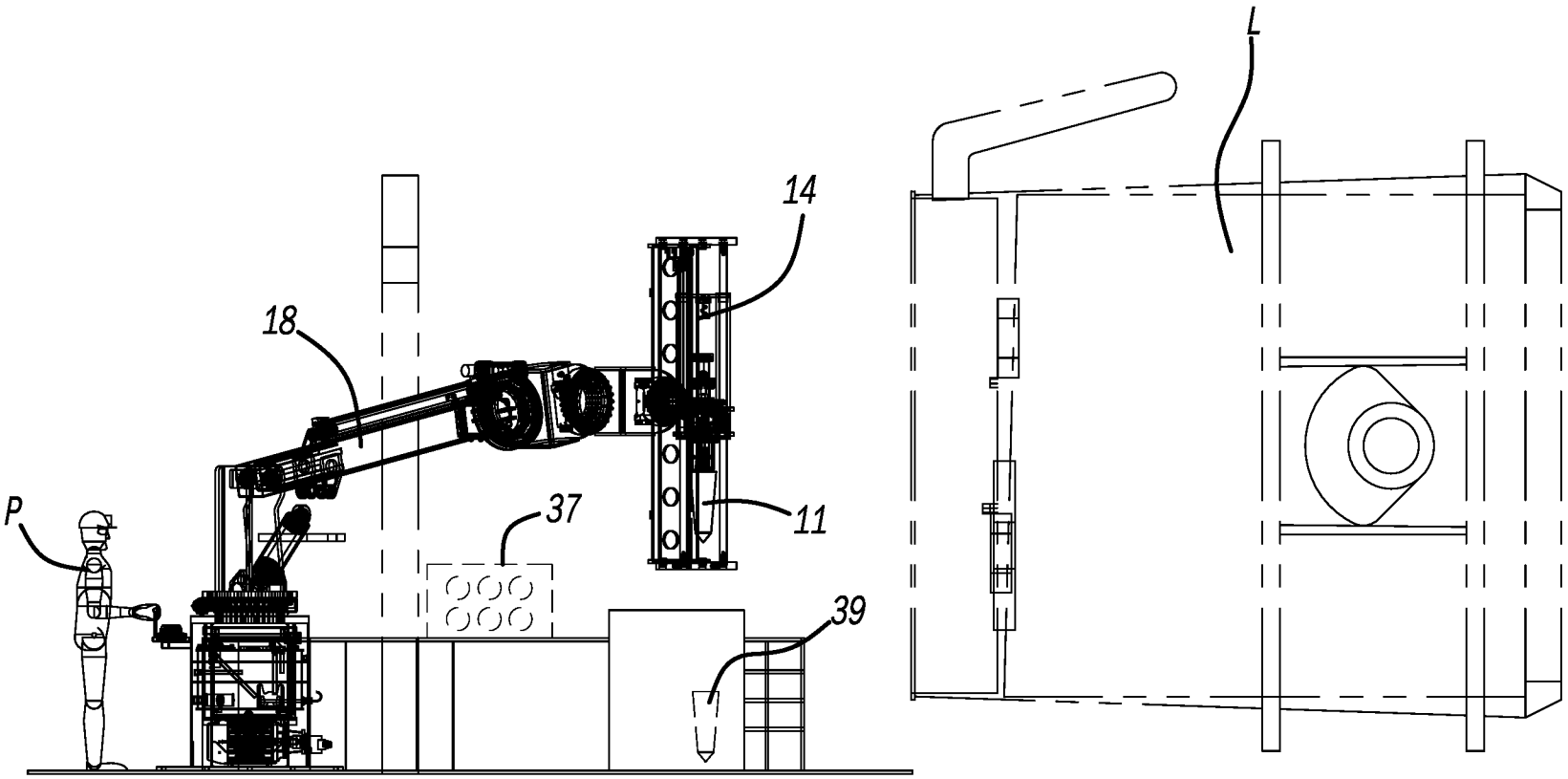
FIG. 8C is a side view of the position of FIG. 8A.

FIGS. 8A-C illustrate the handler 12 in position to load a porous plug 11 from a crate 39 or specially configured crate/shelf 37, in which a plurality of plugs 11 are arranged vertically and pointed downwardly in the crate 39 or are arranged horizontally in the crate/shelf 37. In a vertical storage orientation, the pipe extends upwardly from the plug 11, and is presented for being received and secured by the mast 14, which again may be done in an automated fashion. FIGS. 8A-C illustrates multiple views of the handler 12 in a position to receive the porous plug 11 in its vertical orientation. In another aspect, shown in FIG. 8C, the horizontally aligned crate/shelf 37 is disposed on the platform, and the mast 14 may be arranged horizontally to align with the stored plugs 11. It will be appreciated that other storage orientations and locations may be used, with the mast 14 being moved and/or oriented about and along multiple axes to align with an retrieve/secure the plugs 11.

For example, the crate or rack may be disposed on a platform adjacent the handler 12. The mast 14 may be swung to the left and rotated and pivoted such that the front plate 54 is at the bottom of the vertically oriented mast 14. The mast 14 may be lowered down onto the upwardly projected pipe that is attached to the plug 11. The pipe can be received in the jaw gripper 48, which can be hydraulically or otherwise actuated to automatically grip the pipe. Pipes may be various diameters and lengths and be received and gripped by the jaw gripper 48.

In another aspect, the plugs 11 may be oriented horizontally or at an angle, with the mast 14 being oriented at a corresponding angle to receive the pipe of the plug 11. Plugs 11 may also be moved into another installation position via a magnetic clamp or other transport mechanism to ease manual movement of the plug 11. In another aspect, a magnetic clamp and crane may be used to transport a plug 11 and lower it into the mast 14, with the mast oriented in an opposite vertical orientation to receive the plug 11 from above.

With the plug 11 grasped by the mast 14 and the jaw gripper 48 thereof, the plug 11 may then be rotated and coated with a castable grout mix. The plug 11 may be rotated by hydraulic drive 46 or manually, and thickness may be adjusted or tailored with an angled scraper, if desired. This operation may also form part of an automated process. The angled scraper used for applying and shaping the grout may be a fixed feature or a removable feature.

Once the grout is applied, the mast 14 may be moved to the desired position axially aligned with the port of the ladle L, as described above. The porous plug 11 may then be driven into the port of the ladle L, such as with up to 1000 lbs of force. The plug 11 may be pushed into the port to a uniform depth as desired by the operator. Following insertion of the plug 11, the jaw gripper 48 will release the rod, and the mast 14 may be retracted from the ladle L.

The handler 12 may return to the nominal position shown in FIGS. 7 and 8 following installation of the plug 11. Alternatively, following installation of the plug 11, the handler 12 may be manipulated to grab another plug 11 from the crate or rack.

Figure 9A:
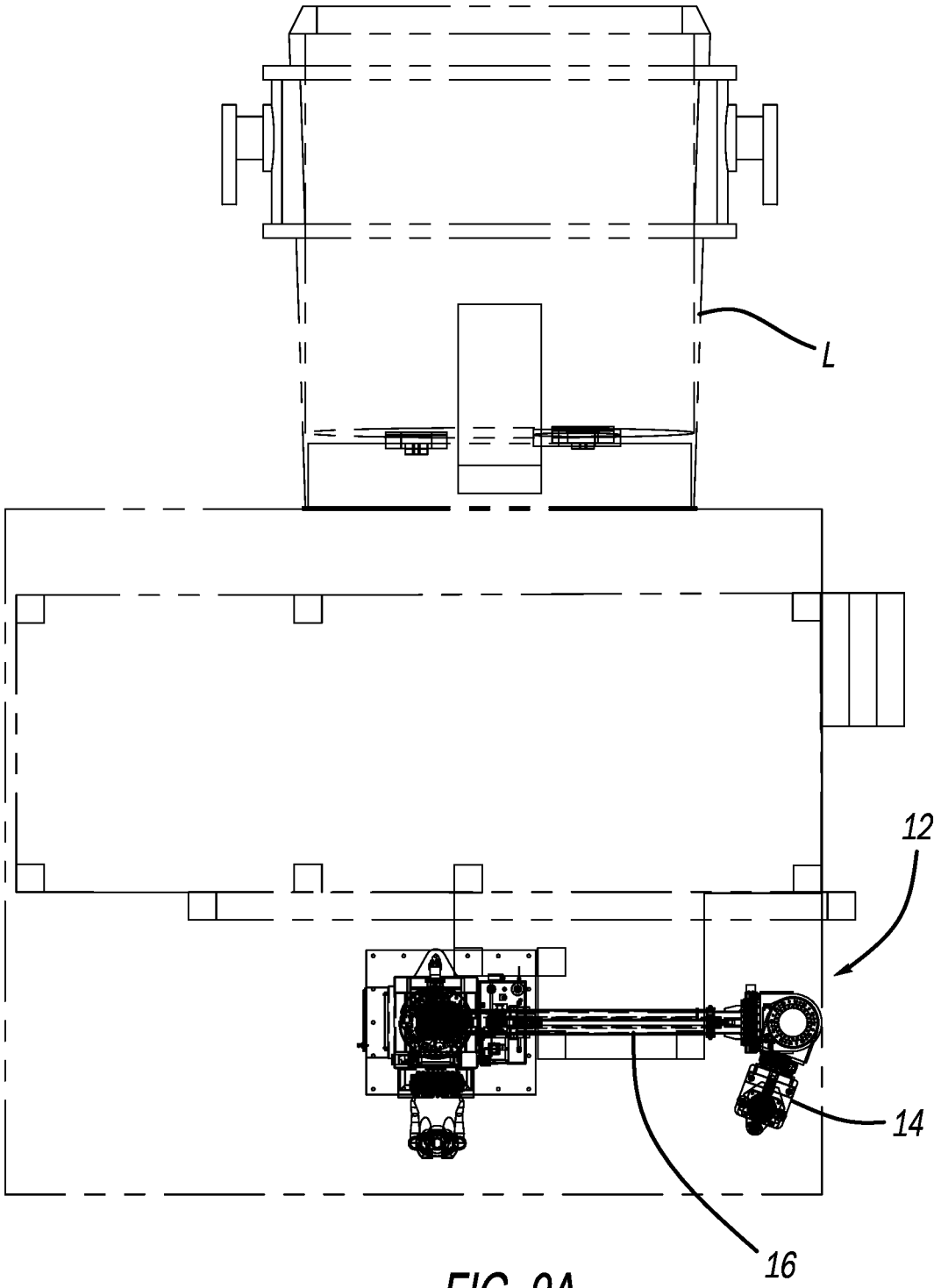
FIG. 9A is a top view of the system in stowed position.
Figure 9B:
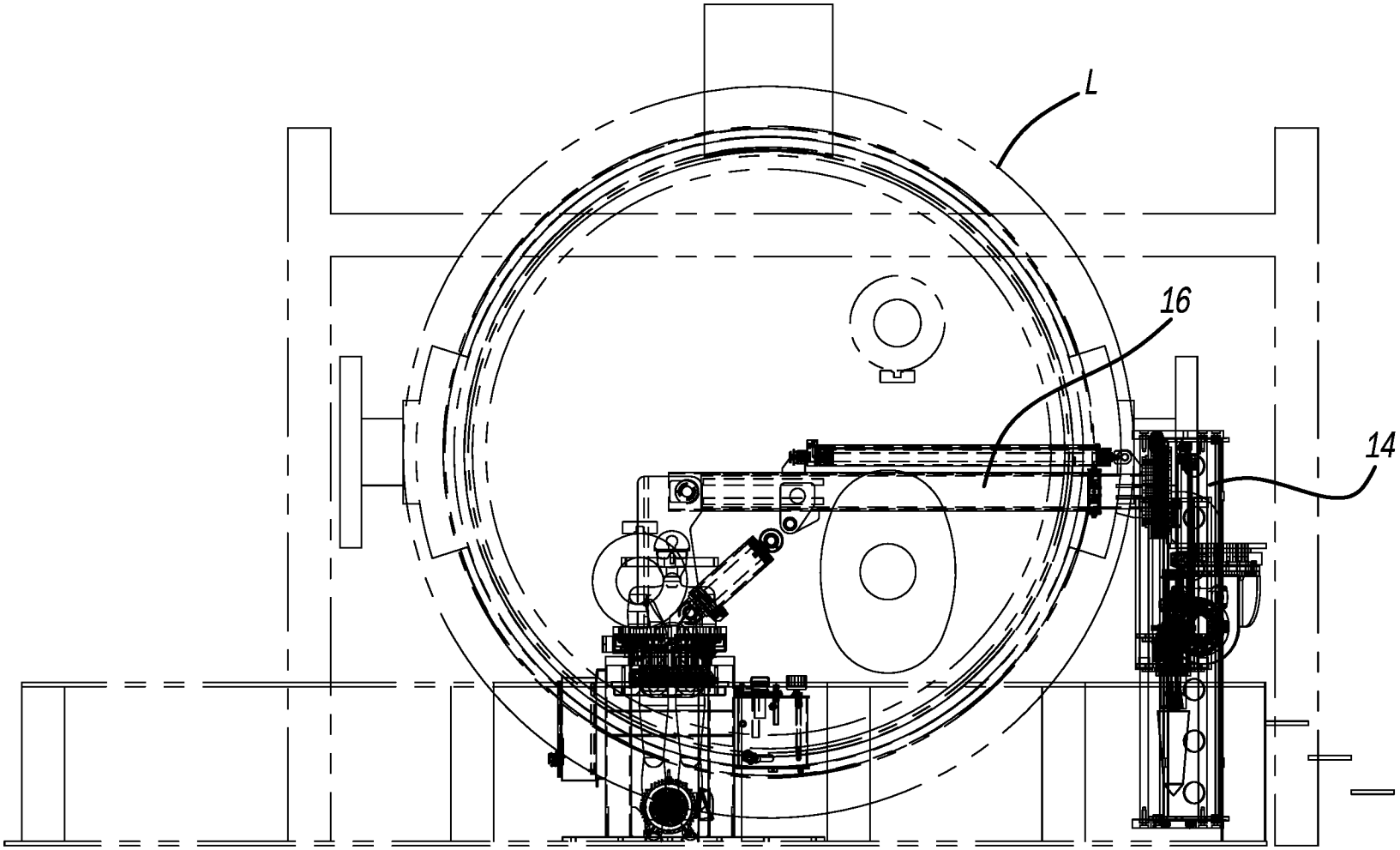
FIG. 9B is a front view of the position of FIG. 9A.
Figure 9C:
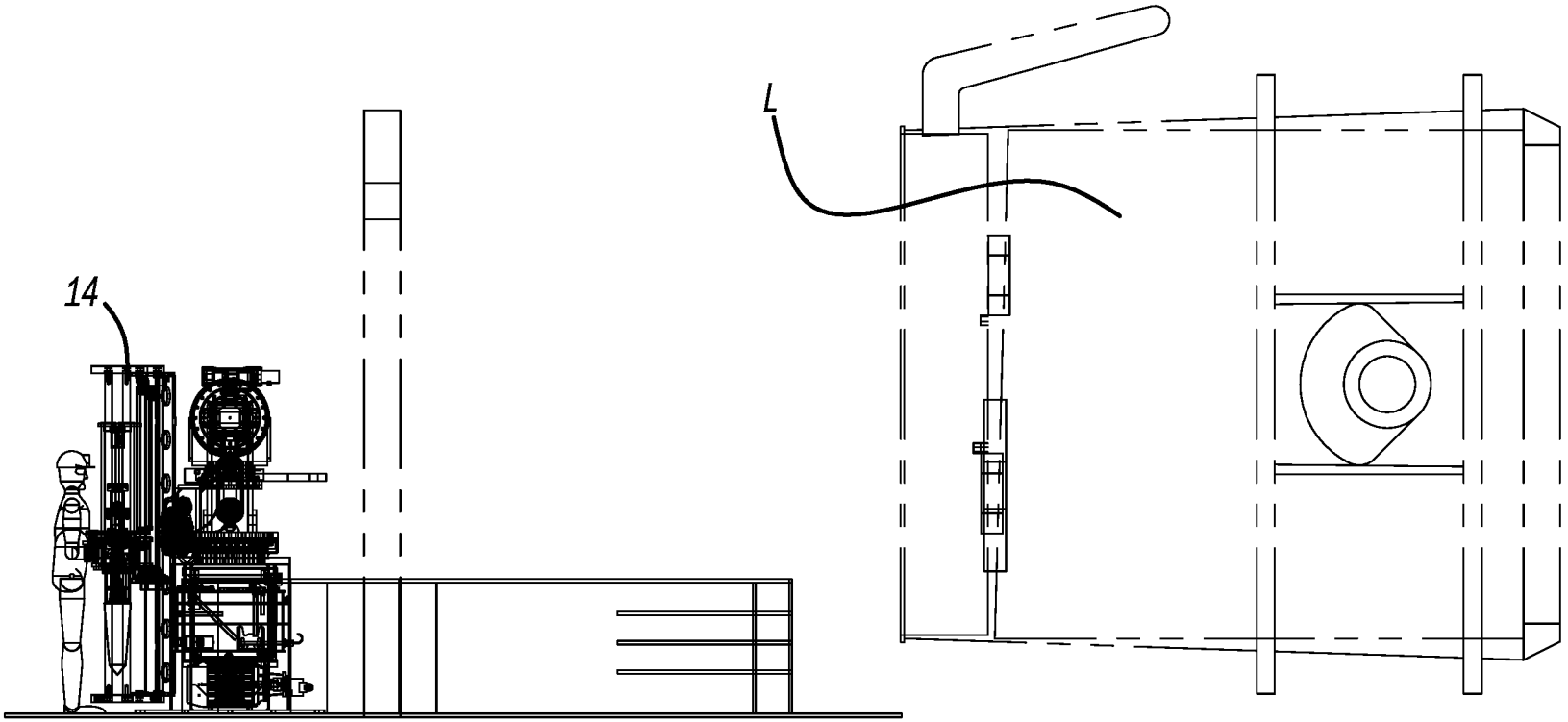
FIG. 9C is a side view of the position of FIG. 9A.

In one aspect, the handler 12 may include a storage position or rest position, shown in FIGS. 9A-C. In this position, the handler 12 has a generally compact footprint, and is pivoted away from the ladle L. The boom 16 may be retracted and rotate to the right from the nominal position via the beam 18. The mast 14 may be oriented vertically to reduce the footprint of the handler 12 on the plant floor. The handler 12 can be moved out of its storage or rest position when necessary for the next plug 11 removal and/or installation.

The handler 12 has been described generally for the installation of the plug 11. However, it will be appreciated that the handler 12 can also be used for plug 11 removal, with the handler 12 gripping the pipe of a spent plug 11 and retracting the plug 11 away from the ladle L via manipulation of the position of the handler 12 after gripping the plug 11.

More particularly, removal of the plug may include a general reversal of the steps described above for installation. The jaw gripper 48 can be positioned relative to the port and pipe of the installed plug 11, which is surrounded by grout at the interface between the plug 11 and the port of the ladle L. The jaw gripper 48 may be controlled to securely grasp the pipe of the porous plug 11. The plug 11 may be rotated via rotation of the jaw gripper 48 to break the grout and break the plug 11 loose from the port of the ladle L. The slider mast may be retracted away from the port, thereby retracting and pulling the plug 11 out of the port. The mast 14 may be disconnected or otherwise removed away from the ladle, via the interconnected linkages of the system, including the gearboxes, boom, etc. The mast 14 may be positioned in a retracted positon where the plug 11 can be released from the jaw gripper 48.

In one approach, similar to the loading of the plug into the mast 14, the mast 14 may be positioned vertically and the plug 11 may be released from the jaw gripper 48 and disposed of with the aid of gravity into a container or the like. The mast 14 need not be positioned perfectly vertical of course to allow for disposal of the plug 11 with the aid of gravity, such that the mast 14 could also be oriented at an angle downward with the end of the plug 11 pointing down.

In one aspect, the jaw gripper 48 may include an associate coolant outlet for introducing coolant into the hollow pipe of the plug 11 while the plug 11 is held in the jaw gripper 48. The end of the pipe may include threading or other attachment mechanism, and the coolant pipe may have a corresponding attachment mechanism arranged to convey coolant into the pipe. Prior to rotation of the plug 11 by the jaw gripper 48, coolant may be introduced into the pipe, thereby causing the hot grout to crack or otherwise weaken, which may reduce the level of rotational force necessary to break the plug 11 free from the port of the ladle L. The coolant may be in a gas form, and may be blown into the interior of the pipe toward the plug, thereby cooling the plug and the adjacent grout. This rapid cooling cannot be tolerated by the hot hardened grout, thereby leading to the rapid shrinking, cracking, and weakening and easing the removal of the plug 11 from the ladle L.

With reference now to FIGS. 10A-D, an alternative mast 114 is provided for controlled alignment with the one of the ports on the ladle L. Reference numbers in this embodiment are similar to those described above increased by "100." It will be appreciated that in some instances the components may be effectively the same, even with different reference numbers, and the various descriptions above are equally applicable unless otherwise noted. The mast 114 includes a front plate 154, shown in FIG. 10B, which includes a locating or indexing bracket 155, which may be referred to as mast bracket 155, fixed to the mast 114 and front plate 154 and disposed below the mast 114 and front plate 154, extending rearward and away from the ladle L. Mast bracket 155 also extends across the mast 114, and may have a width approximately the same as the mast 114.

The mast bracket 155 includes at least one depending flange or lug 155*a* that extends downward from a generally horizontal base portion. The lug 155*a* (which may be a pair of spaced apart lugs or an elongate projection) includes downwardly facing concave recess 155*b*, configured to receive and/or to be placed upon a corresponding rod, bar, or the like for the purpose of indexing/locating the mast 114 with one of the ports of the ladle L.

The ladle L may include a ladle bracket 157 configured to be coupled with the mast bracket 155 during aligned of the mast 114 with the port of the ladle L. The ladle bracket 157 may include a bar 157*a* that extends generally laterally/horizontally across the bottom face of the ladle L that is presented to the mast 114. When the mast 114 is aligned with the port of the ladle L and brought to the correct position, the bar 157*a* is generally parallel to the front plate 154 and rearward of the front plate 154. The bar 157*a* may in this positioned be aligned with and received within the concave recess 155*b* and may support the end of the mast 114 when the mast 114 is correctly positioned relative to the port of the ladle L.

The mast bracket 155 may be attached to the mast via bolts, welding, or other mechanical fastening approaches. The ladle bracket 157 may likewise be fixed to the bottom of the ladle L in the desired position relative to the ports of the ladle L. In one example, the ladle bracket 157 is welded to the bottom of the ladle L in the desired position. In another example, the ladle bracket 157 may be removably secured to the bottom of the ladle L via bolts or the like. A common hole pattern may be used for the ladle bracket 157 and or the ladle L to allow the ladle bracket 157 to be located in alternative locations relative to the port, or to allow for the ladle bracket 157 to be changed out and replaced with a different sized ladle bracket 157 (or in the event of damage requiring replacement). The position of the ladle bracket 157 on the ladle relative to the port may be determined based on the size and arrangement of the mast 114 and mast bracket 155. It will be appreciated that the specific arrangement with regarding to specific lengths and relative distances may be selected to permit the mast 114 to be positioned as desired relative to the port of the ladle L.

Similar to the use of locating plates 64 and 66, the ladle L may include two ladle brackets 157.

Figure 10A:
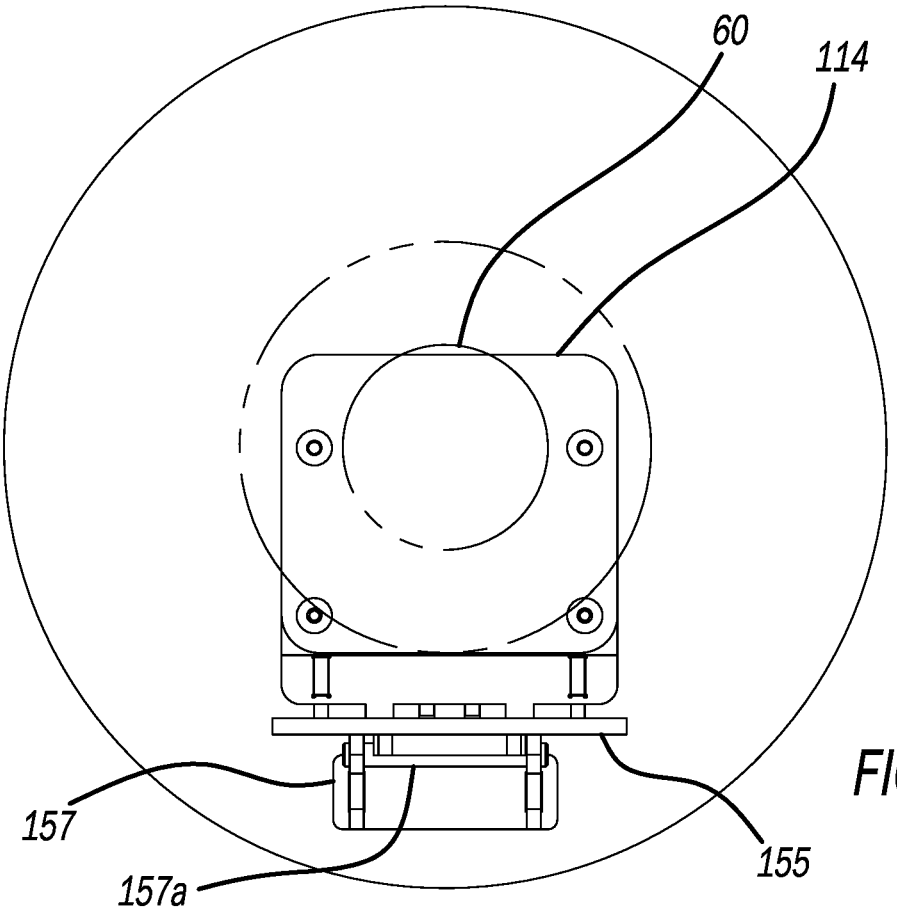
FIG. 10A is a front view of an altnerative locating feature of the mast for locating the mast with a port of the ladle.
Figure 10B:
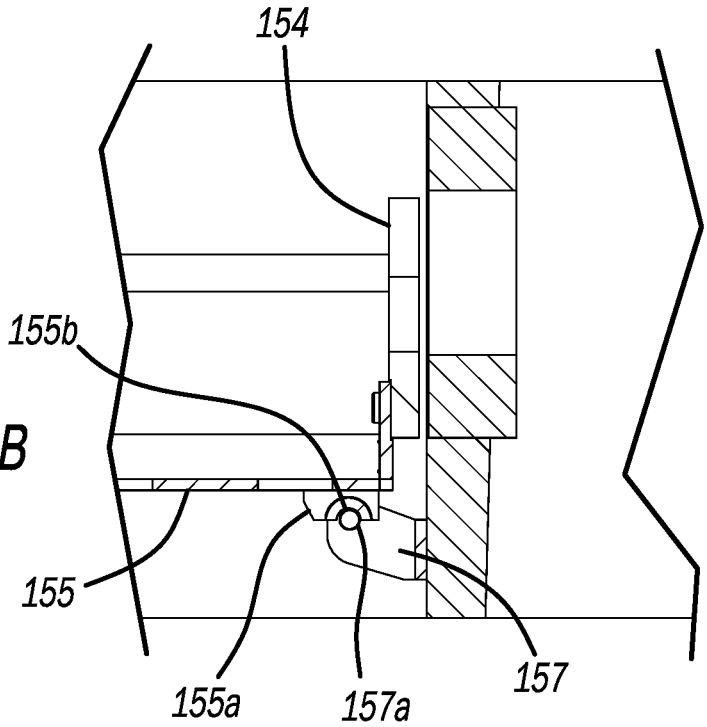
FIG. 10B is a cross-sectional view of the mast being aligned with a corresponding locating feature on the ladle, with a rod of a ladle bracket being receive in a concave recess of a mast bracket.
Figure 10C:
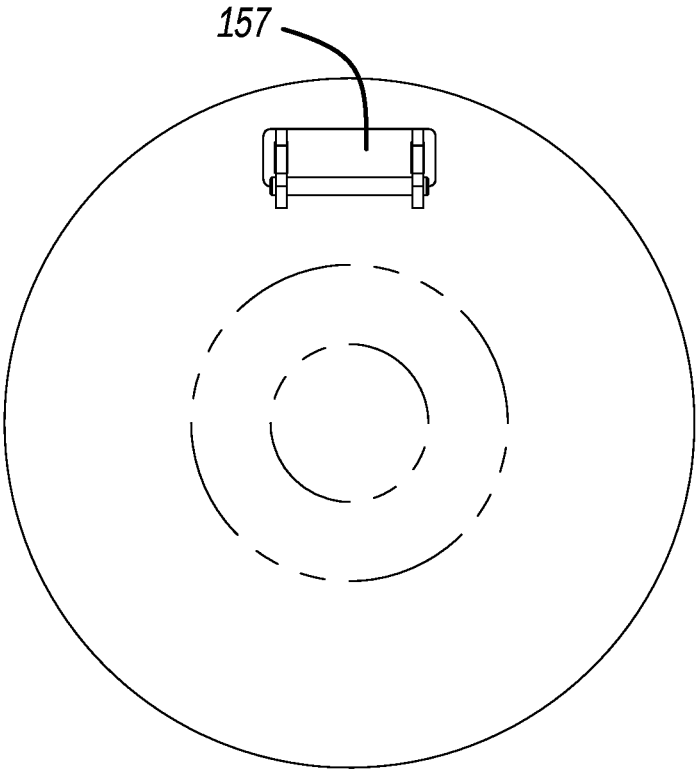
FIG. 10C is a front view of another port and corresponding location feature of the ladle.
Figure 10D:
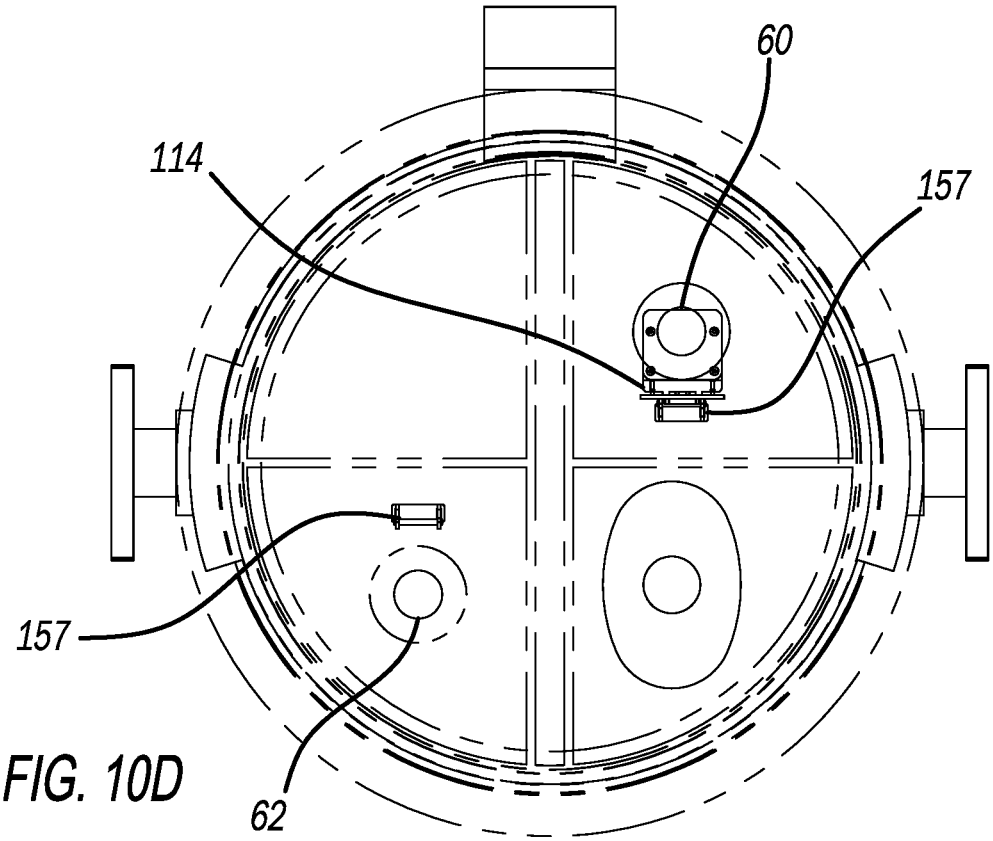
FIG. 10D is a front view of the ladle illustrating multiple ports.

FIG. 10D illustrates ports 160 and 162 of the ladle L, with FIGS. 10A and 10C providing detailed views. Port 160 is disposed at approximately "2 o'clock" on the bottom face of the ladle L, with port 162 disposed at about "8 o'clock" on the bottom of the ladle L. In this aspect, the ports are about 180 degrees apart, or diametrically opposed relative to the central axis of the ladle L. It will be appreciated that these particular locations are one example, and that different ladle configurations can include fewer ports, more ports, and/or ports located in different locations on the bottom face of the ladle L. It will also be appreciated that throughout the figures the ladle L is shown on its side, such that the bottom face of the ladle L is presented to the handler 12 and such that the porous plug 11 may be inserted horizontally toward the ports of the ladle L.

In the illustrated arrangement, with ports 160 and 162 being diametrically opposed, the ladle L, if rotated on its side in the opposite direction from vertical would result in ports 160 and 162 appearing similar when viewing the bottom face, with one at 2 o'clock and the other at 8 o'clock, but reversed. Port 162 would be at 2 o'clock and port 160 would be at 8 o'clock.

FIG. 10A illustrates the mast 114 and front plate 154 axially aligned with the port 160. In this illustration, ladle L includes ladle bracket 157 welded or otherwise secured to the bottom face of the ladle L. The ladle bracket 157 has the bar 157*a* disposed below port 160 to align and support the mast a14 relative to the port 160. FIG. 10C similarly illustrates a ladle bracket 157 welded or otherwise secured to the bottom face of the ladle L, with the ladle bracket 157 disposed above port 162. Thus, as shown, ladle bracket 157 is at the bottom of the port 160 and ladle bracket 157 is at the top of the port 162. It will be appreciated that the ladle brackets 157 could both be at the top or at the bottom. In another aspect, multiple ladle brackets 157 can be disposed around a single port, such that plates are disposed at both the top and the bottom of the port. The ladle brackets 157 could also be arranged to the side of the ports while still performing their indexing function.

In the case of the ladle L being rotated to its side in the opposite direction, as described above, the arrangement where one of the ladle bracket 157 is above its corresponding port and the other locating is below its corresponding port would be similarly arranged, due to the illustrated 180 degree symmetry.

The ladle bracket 157 provides added functionality during the use of the system. For example, during insertion of the plug 11 or retraction of the plug 11, reaction forces form the plug/ladle in the axial/insertion/removal direction may act on the interconnected parts of the system, including but not limited to the gearboxes 26, 30, 28, brackets 22, 24, boom 16, and boom extend cylinder 32. Because the bar 157*a* is positively located within the recess 155*b*, the reaction forces react on the mast 114 and ladle L, rather than the components supporting the mast 114, thereby increasing the life of these components and reducing the possibility of fatigue or other damages on the various linkages.

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional components), feature(s), characteristic(s), parameter(s), integer(s), step(s), or groups thereof. Each of these terms is considered equivalent in meaning to the phrase "consisting essentially of. Each of the phrases "consisting of and "consists of," as used herein, means "including and limited to."

The phrase "consisting essentially of," as used herein, means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic being a system unit system sub-unit device, assembly, sub-assembly, mechanism, structure, component or element or, peripheral equipment utility, accessory, or material, step or procedure, sub-step or sub-procedure, but only if each such additional feature or characteristic does not materially alter the basic novel and inventive characteristics or special technical features, of the claimed item.

The term "method," as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value. "Generally polygonal" means that the shape has flat surfaces, as with a polygon, but may have rounded corners connecting these surfaces.

The phrase "operatively connected," as used herein, equivalently refers to the corresponding synonymous phrases "operatively joined", and "operatively attached," where the operative connection, operative joint or operative attachment, is according to a physical, or/and electrical, or/and electronic, or/and mechanical, or/and electro-mechanical, manner or nature, involving various types and kinds of hardware or/and software equipment and components.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

The invention claimed is:

1. A system for installing and removing a porous plug for a port of a metallurgic ladle, the system comprising:

a handler configured for selectively securing and transporting the porous plug to and from the metallurgic ladle, the handler comprising:

a mast disposed at a first end of the handler, the mast configured for retaining the porous plug during transport;

an extendable boom rotatably coupled to the mast, wherein the mast is rotatably moveable relative to the extendable boom to control alignment of the mast in response to movement of the extendable boom; and a base configured for being secured to a plant floor, wherein the extendable boom is moveable relative to the base to align the mast with the port;

wherein the boom is pivotable up and down relative to the base and pivotable left to right relative to the base;

wherein the mast and boom are moveable relative to each other, such that the mast is positionable in an axially aligned position with a port of the ladle when the extendable boom is moved relative to the base; and wherein the mast is pivotable both up-and-down and left-to-right in response to corresponding pivoting movement of the boom to position the mast in axial alignment with the port of the ladle.

2. The system of claim 1, wherein the mast is coupled to the boom via first and second brackets, wherein the mast is rotatable relative to the first bracket, the first bracket is rotatable relative to the second bracket, and the second bracket is rotatable relative to the extendable boom.

3. The system of claim 2, wherein the first and second brackets are right angle brackets.

4. The system of claim 2, wherein the mast is rotatable relative to the first bracket via a mast swing gearbox, the first bracket is rotatable relative to the second bracket via a middle tilt gearbox, and the second bracket is rotatable relative to the extendable boom via a mast tilt gearbox.

5. The system of claim 1, wherein the mast includes a pair of slider rails extending longitudinally along the mast, and a slider is slidable along the mast to advance and retract a porous plug secured thereto.

6. The system of claim 1, wherein the mast includes a jaw gripper configured for securing a pipe of the porous plug.

7. The system of claim 6, wherein the mast includes a plug rotation drive for rotating the porous plug within the mast.

8. The system of claim 1, wherein the extendable boom is pivotably attached to a rotatable beam and pivotable relative to the beam, wherein the beam is rotatable relative to the base via a boom slew gearbox.

9. The system of claim 1, wherein the handler is hydraulically controllable to raise, lower, and extend the extendable boom and to advance, retract, and rotate the porous plug secured to the mast.

10. The system of claim 4, wherein the mast is rotatable 360 degrees relative to the first bracket, the first bracket is rotatable 360 degree relative to the second bracket, and the second bracket is rotatable 360 degrees relative to the extendable boom.

11. The system of claim 4, wherein the second bracket is rotatable about a longitudinal axis of extension of the extendable boom.

12. The system of claim 4, wherein an axis rotation of the mast relative to the first bracket extends through a mid-section of the mast and is perpendicular to a longitudinal axis of the mast and the direction of insertion of the porous plug.

13. The system of claim 1, wherein the mast is positioned and aligned vertically for receiving the porous plug and is positioned and aligned horizontally for inserting the porous plug.

14. The system of claim 1, wherein the handler has a nominal position, separated from the ladle, in which the mast and extendable boom are aligned in a first direction parallel to each other and oriented horizontally.

15. The system of claim 14, wherein the system has a storage position, separated from the ladle, in which the extendable boom is positioned horizontally and perpendicular relative to the nominal position, and the mast is positioned vertically.

16. The system of claim 1, wherein the mast includes at least one locating feature at a front end thereof, wherein the locating feature is sized and arranged to mate with corresponding structure disposed on the ladle when the mast is aligned with the port.

17. The system of claim 16, wherein the corresponding structure is a locating plate defining a notch, and the locating feature on the mast is a pin.

18. The system of claim 16, wherein the corresponding structure is a locating bracket including a bar, and the locating feature is a concave recess.

19. The system of claim 18, wherein the bar is received in the concave recess in a positive manner and arranged to receive an axial reaction force between the mast and the ladle during installation or removal of the plug.

20. A method of installing or removing a porous plug to or from a port of a metallurgic ladle, the method comprising:

rotating an extendable boom about a vertical axis and rotating a mast relative to the extendable boom, wherein the mast is rotatably connected to an end of the extendable boom;

tilting the boom up and/or down relative to a base that is remote from the ladle and raising or lowering the boom;

rotatably adjusting the mast relative to the boom in response to raising or lowering the boom, and orienting the mast horizontally;

rotatably adjusting the mast relative to the boom in response to rotating the boom about the vertical axis and thereby aligning an insertion/removal axis of the mast with the port of the ladle;

securing a porous plug to a slider mast; and translating the slider mast having the porous plug secured thereto along the insertion/removal axis.

21. The method of claim 20, further comprising:

securing the porous plug within the mast via jaw grippers; and advancing the plug via the translation of the slider mast toward and into the port of the ladle.

22. The method of claim 21, further comprising advancing the mast into engagement with the ladle, wherein the mast includes a locating feature, and mating the locating feature with a corresponding locating feature on the ladle.

23. The method of claim 22, wherein the locating feature is a pin disposed on a front plate of the mast, and the corresponding locating feature is a notch defined in a locating plate attached to the ladle.

24. The method of claim 22, wherein the locating feature is a bracket having a concave recess and the corresponding locating feature is a bar attached to the ladle.

25. The method of claim 22, wherein a reaction force during insertion or removal of the ladle is reacted on by the bar and recess in the direction of insertion/removal.

26. The method of claim 20, further comprising:

securing the porous plug within the mast via jaw grippers while the plug is secured to the ladle; and retracting the plug via the translation of the slider mast toward and into the port of the ladle.

27. The method of claim 26, further comprising, prior to retracting the plug, introducing air or gas to the plug via the pipe and cooling the plug.

28. The method of claim 27, wherein cooling the plug causes grout surrounding the plug to crack, thereby loosening the plug relative to the ladle.

29. The method of claim 20, further comprising, prior to securing the plug to the mast, orienting the mast vertically and, thereafter, advancing the mast onto a vertically aligned plug and securing the plug within the mast.

30. The method of claim 20 further comprising, after securing the plug to the mast, removing the plug from the ladle and, thereafter, orienting the mast vertically and releasing the plug.

31. The method claim 20, wherein the extendable boom is pivotable about the vertical axis via a boom slew gearbox, the mast is rotatable relative to the boom via a middle tilt gearbox, and the mast is further rotatable relative to the extendable boom via a mast swing gearbox.

32. The method of claim 31, further comprising correspondingly rotating the mast via the mast swing gearbox in response to pivoting the extendable boom about the vertical axis to maintain an alignment of the mast relative to the ladle.

33. The method of claim 20, wherein the boom, mast, and slider mast are positionable automatically by a controller having a processor and a non-transitory computer readable medium with instructions stored thereon and configured for automatically controlling the positions, and wherein the steps are automated by the controller.

34. A system for installing a porous plug in a port of a metallurgic ladle, the system comprising:

a mast configured for selectively securing and transporting the porous plug to and from the metallurgic ladle, the mast configured for rotating the porous plug while the mast remains stationary;

wherein the mast is positionable relative to an extendable boom, wherein the boom is rotatable at a first end about a vertical axis and pivotable up and/or down at the first end, and the mast is coupled to a second end of the boom and rotatable about multiple axes to maintain the mast in alignment with the ladle while the boom is rotated and/or pivoted.

35. The system of claim 34, wherein the mast comprises a slider mast configured to translate the porous plug to and/or from a port of the metallurgic ladle.

36. A method of installing a porous plug in a port of a metallurgic ladle, the method comprising:

connecting a mast with a porous plug in a container;

using the mast to rotate the porous plug relative to the mast;

applying a coating to the porous plug during rotation; and advancing the plug via the mast into the port of the metallurgic ladle.

37. A method of installing a porous plug in a port of a metallurgic ladle, the method comprising:

connecting a mast with a porous plug in a container;

rotating the mast about multiple axes relative to an extendable boom coupled to the mast, wherein the mast is rotated to corresponding to the rotation of the boom about a vertical axis and/or pivoting of the boom up and/or down to maintain the mast in a given orientation; and advancing the plug via the mast into the port of the metallurgic ladle.

* * * * *